US009423759B2

(12) United States Patent
Sato et al.

(10) Patent No.: US 9,423,759 B2
(45) Date of Patent: Aug. 23, 2016

(54) IMAGE FORMING APPARATUS

(71) Applicant: Brother Kogyo Kabushiki Kaisha, Nagoya-shi, Aichi-ken (JP)

(72) Inventors: Shougo Sato, Seto (JP); Atsushi Fukui, Toyota (JP); Isao Fukuchi, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/813,542

(22) Filed: Jul. 30, 2015

(65) Prior Publication Data

US 2016/0033927 A1 Feb. 4, 2016

(30) Foreign Application Priority Data

Jul. 31, 2014 (JP) ..... 2014-156899

(51) Int. Cl.
*G03G 21/10* (2006.01)

(52) U.S. Cl.
CPC ..... *G03G 21/105* (2013.01)

(58) Field of Classification Search
CPC ..... G03G 21/105
See application file for complete search history.

(56) References Cited

U.S. PATENT DOCUMENTS 8,583,023 B2 11/2013 Yuasa
2009/0324284 A1* 12/2009 Ohta ..... G03G 21/12 399/120
2011/0044743 A1 2/2011 Yuasa
2011/0229209 A1* 9/2011 Takaya ..... G03G 15/0844 399/257
2014/0334842 A1 11/2014 Fukuchi et al.

FOREIGN PATENT DOCUMENTS

JP 2010008472 A * 1/2010
JP 2011-043568 A 3/2011
JP 2014-219599 A 11/2014

OTHER PUBLICATIONS

JP 2010-008472 English translation, Hayakawa, Jan. 14, 2010.*

* cited by examiner

*Primary Examiner* — David Gray
*Assistant Examiner* — Thomas Giampaolo, II
(74) *Attorney, Agent, or Firm* — Banner & Witcoff, Ltd.

(57) ABSTRACT

An image forming apparatus, including a body with an aperture, a processing unit movable between an inside position and an outside position, and a transfer unit, is provided. The processing unit includes first and second drum cleaners to remove waste toner from first and second photosensitive drums respectively; and a waste toner conveyer including a conveyer tube longitudinally extending in a movable direction of the processing unit, a port, a conveyer screw located inside the conveyer tube, and a shutter movable between an opening position and a closed position to open and close the port. The transfer unit includes a belt unit with a belt arranged to contact the first photosensitive drum and the second photosensitive drum, and a belt cleaner including a container with an opening which communicates with the port of the conveyer tube when the processing unit is in the inside position.

21 Claims, 21 Drawing Sheets

IMAGE FORMING APPARATUS

CROSS REFERENCE TO RELATED APPLICATION

This application claims priority from Japanese Patent Application No. 2014-156899, filed on Jul. 31, 2014, the entire subject matter of which is incorporated herein by reference.

BACKGROUND

1. Technical Field

An aspect of the present invention relates to an image forming apparatus capable of forming images in an electrophotographic method.

2. Related Art

An image forming apparatus, such as a tandem-typed color printer, for forming colored images in an electro-photographic method is known. The tandem-typed color printer may have a plurality processing units, each of which contains a photosensitive drum for one of a plurality of colors (e.g., yellow, magenta, cyan, and black).

The tandem-typed color printer may be equipped with a cleaning system, in which residual toner remaining on surfaces of the photosensitive drums is scraped off by cleaning blades, and the residual toner removed from the photosensitive drums may be conveyed sideward along a direction of axes of the photosensitive drums by conveyer spirals in a toner collecting unit so that the collected residual toner is conveyed by a toner conveyer unit to be stored in a waste toner container disposed inside the image forming apparatus.

SUMMARY

While the plurality of processing units may be integrally supported by a supporting member in the image forming apparatus, the supporting member may be configured to further support the toner conveyer unit. Meanwhile, the waste toner container may be detachable from and attachable to the toner conveyer unit while the toner conveyer may be stationary inside the image forming apparatus.

The present disclosure is advantageous in that an image forming apparatus, in which a supporting member to support a plurality of processing unit may support a toner conveyer unit, and the toner conveyer unit may be detachably attached to the toner container unit, is provided.

According to an aspect of the present invention, an image forming apparatus, having a body including a first wall, the first wall having an aperture, and a second wall opposite to the first wall; and a processing unit movable between an inside position, in which the processing unit is inside the body, and an outside position, in which the processing unit is outside the body, through the aperture in the body, is provided. The processing unit includes a first drum cleaner configured to remove waste toner from a first photosensitive drum, the first drum cleaner including a first cleaning blade arranged to contact the first photosensitive drum, and a first screw longitudinally extending in an axial direction of the first photosensitive drum; a second drum cleaner configured to remove waste toner from a second photosensitive drum, the second drum cleaner including a second cleaning blade arranged to contact the second photosensitive drum, and a second screw longitudinally extending in an axial direction of the second photosensitive drum; and a waste toner conveyer configured to convey the waste toner removed by the first drum cleaner and the second drum cleaner, the waste toner conveyer including a conveyer tube longitudinally extending in a movable direction in which the processing unit is movable from the outside position to the inside position, the waste toner conveyer having a port, a conveyer screw located inside the conveyer tube, and a shutter movable between an opening position, in which the port is open, and a closed position, in which the port is closed, the port of the conveyer tube being arranged closer to the first wall of the body than to the second wall of the body when the processing unit is in the inside position. The image forming apparatus further has a transfer unit, including a belt unit with a belt arranged to contact the first photosensitive drum and the second photosensitive drum; and a belt cleaner including a container, the container having an opening which communicates with the port of the conveyer tube when the processing unit is in the inside position.

BRIEF DESCRIPTION OF THE ACCOMPANYING DRAWINGS

Figure 4A:
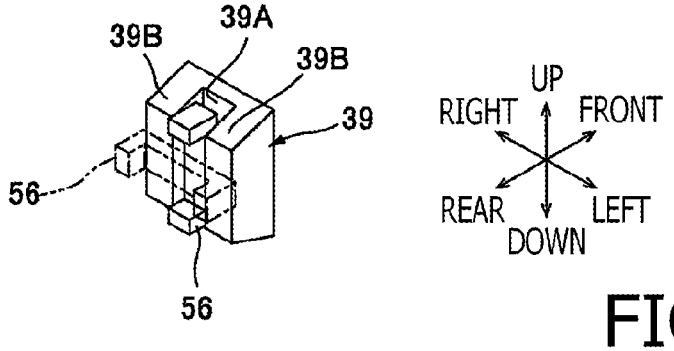
Figure 4B:
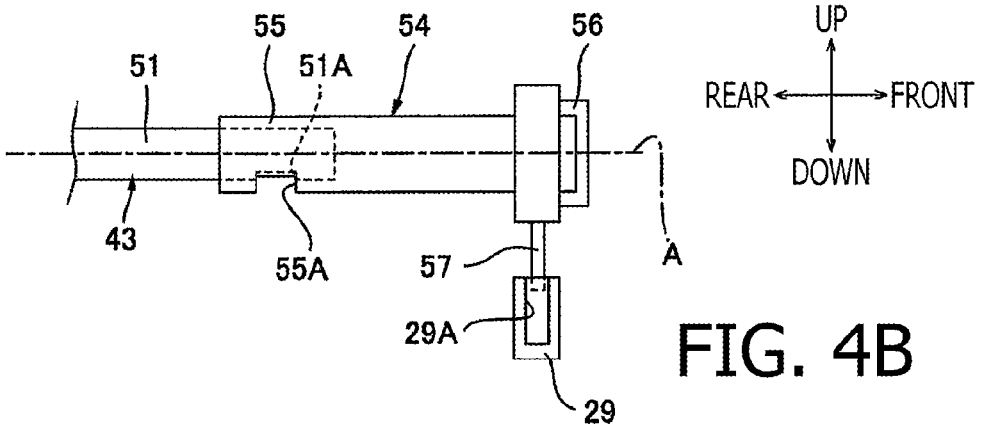
Figure 4C:
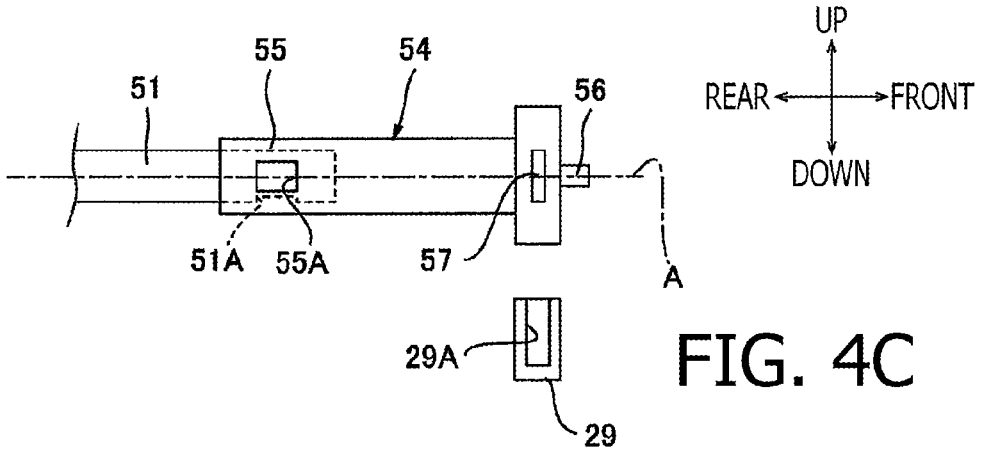

FIG. 4A illustrates engagement between a handle in a shutter and a shutter-restrictive part in a front cover in the image forming apparatus according to the first embodiment of the present disclosure. FIG. 4B illustrates the shutter in an opening position in the image forming apparatus according to the first embodiment of the present disclosure. FIG. 4C illustrates the shutter in a closable position in the image forming apparatus according to the first embodiment of the present disclosure.

Figure 2:
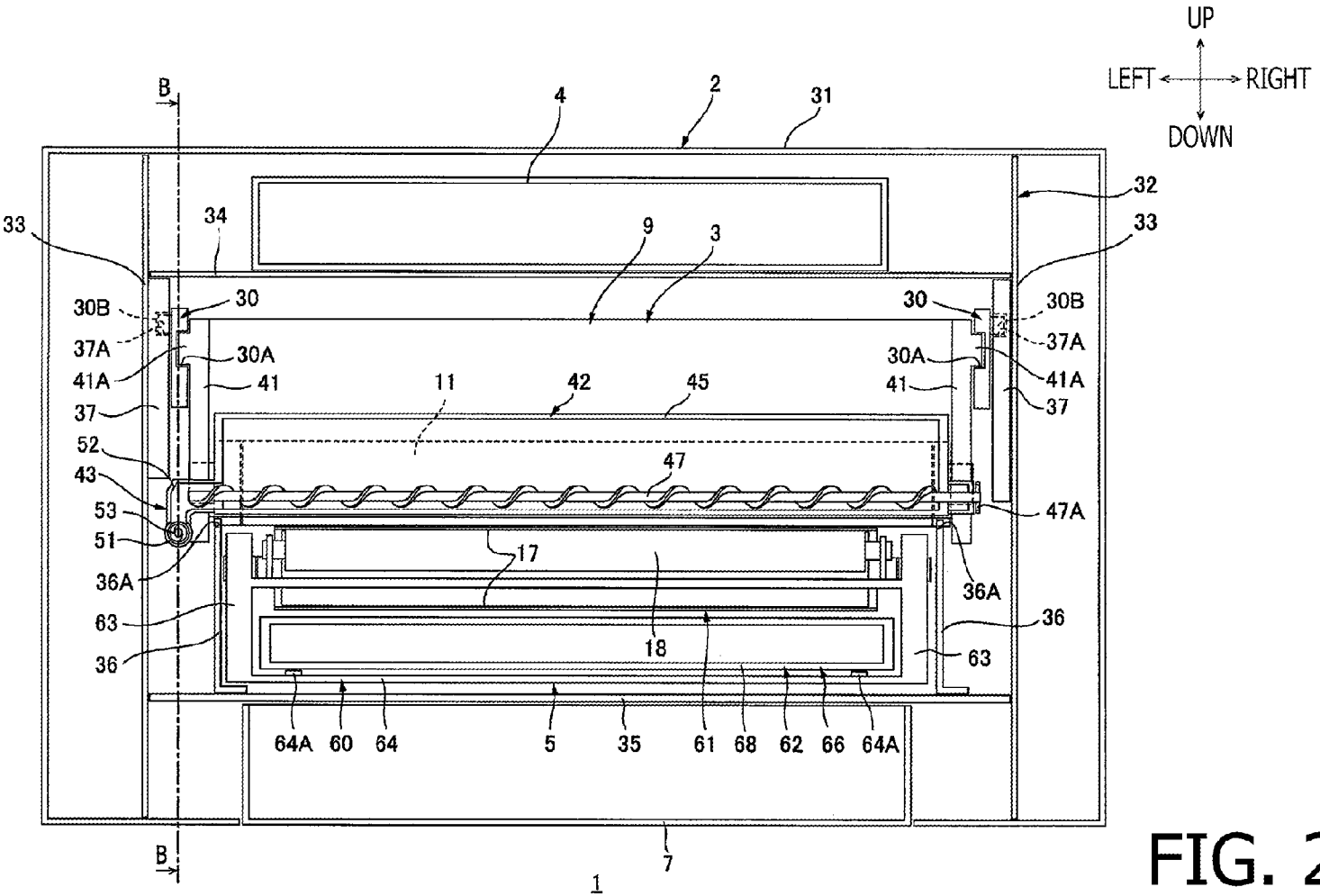
FIG. 2 is a cross-sectional view of the image forming apparatus, taken at a line A-A shown in FIG. 1, according to the first embodiment of the present disclosure.
Figure 5A:
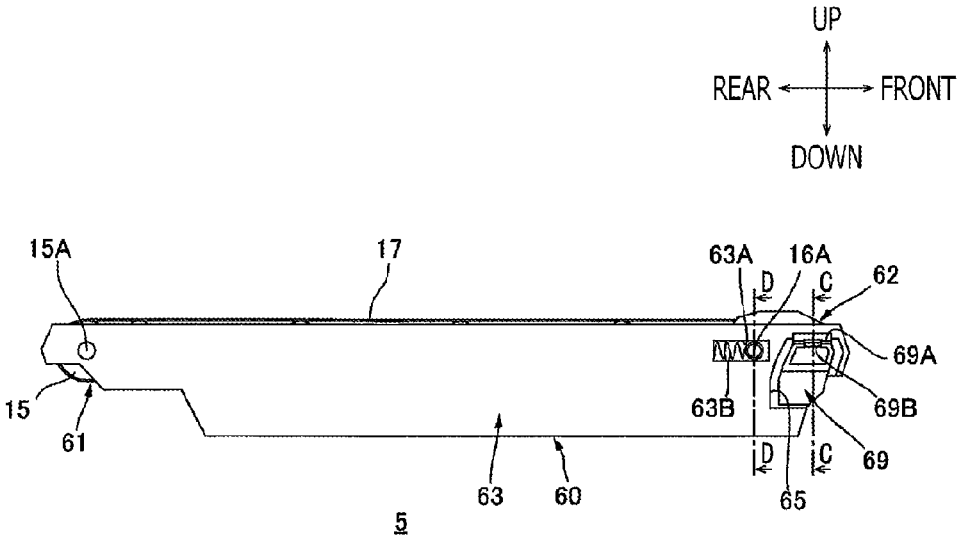
Figure 5B:
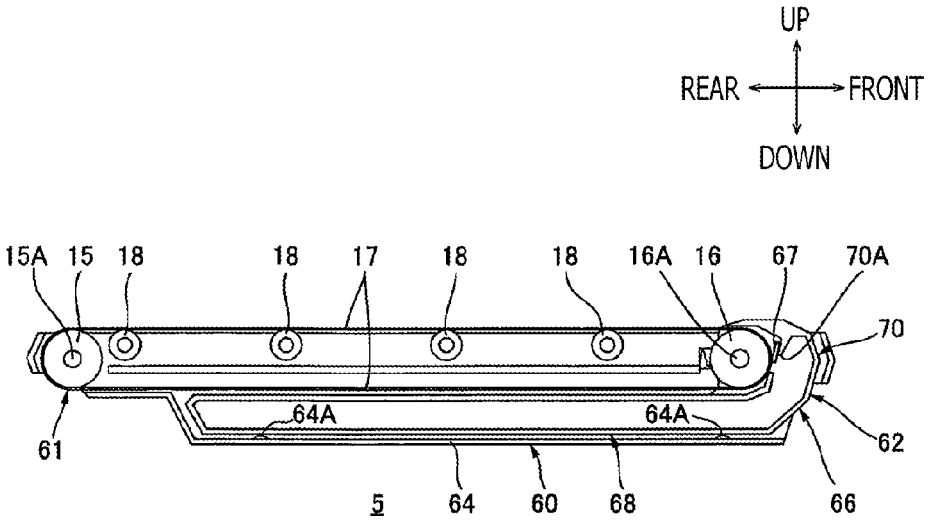

FIG. 5A is a cross-sectional view of a transfer unit in the image forming apparatus, taken at the line B-B shown in FIG. 2, according to the first embodiment of the present disclosure. FIG. 5B is a cross-sectional view of the transfer unit in the image forming apparatus, taken at a widthwise center, according to the first embodiment of the present disclosure.

Figure 6A:
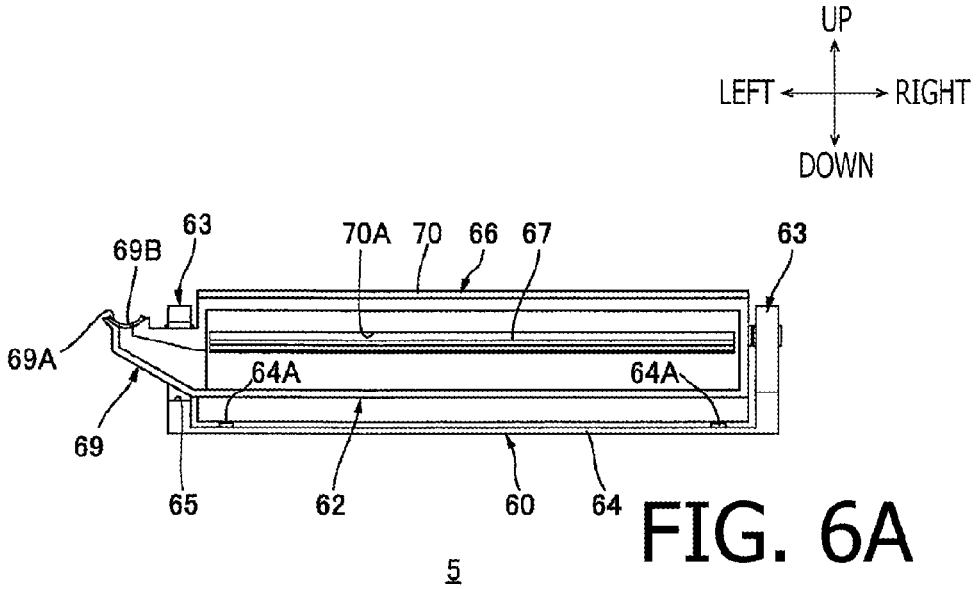
Figure 6B:
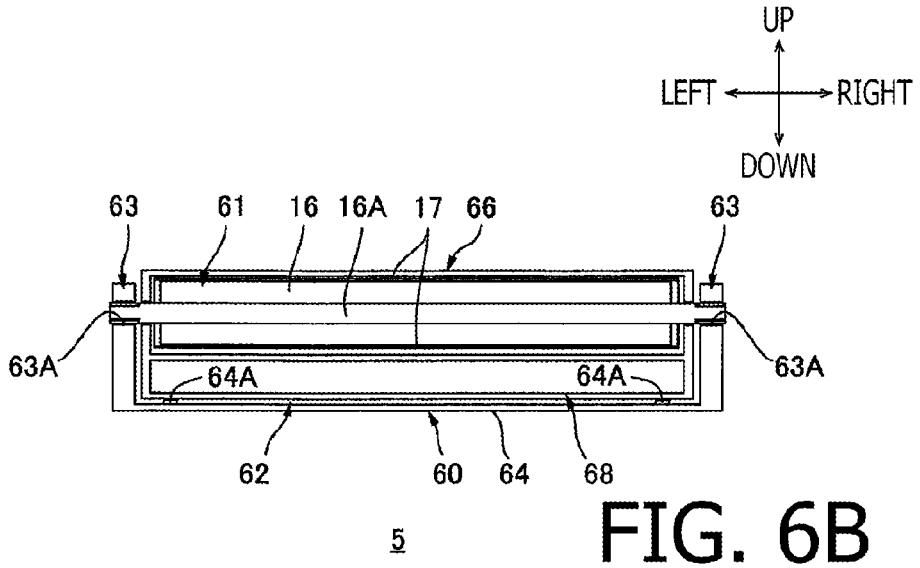

FIG. 6A is a cross-sectional view of the transfer unit in the image forming apparatus, taken at a line C-C shown in FIG. 5A, according to the first embodiment of the present disclosure. FIG. 6B is a cross-sectional view of the transfer unit in the image forming apparatus, taken at a line D-D shown in FIG. 5B, according to the first embodiment of the present disclosure.

Figure 7:
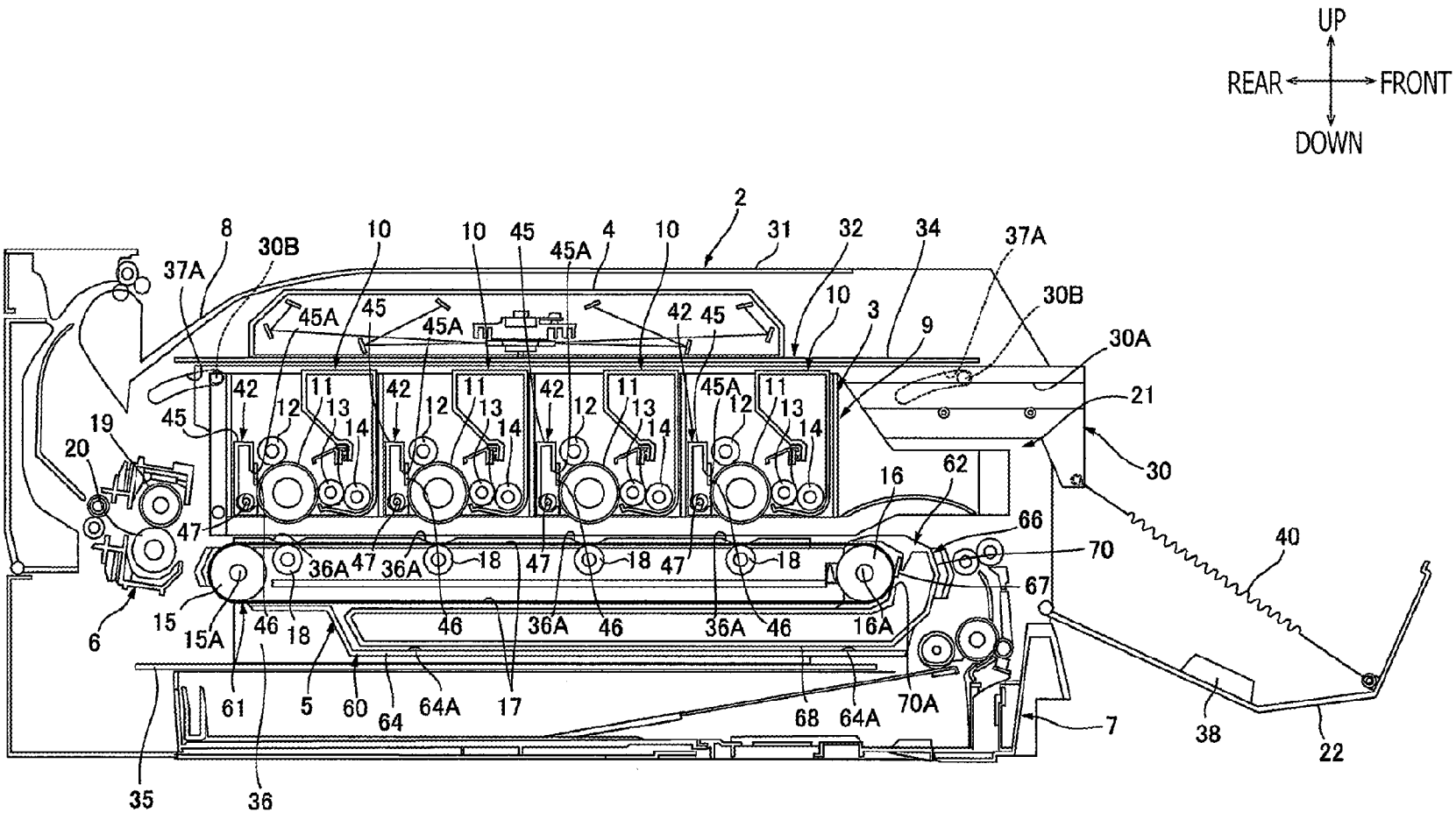

FIG. 7 is a cross-sectional view of the image forming apparatus when a developer cartridge is to be exchanged, with the front cover being in an openable position and a processing unit being in a separated position, according to the first embodiment of the present disclosure.

Figure 1:
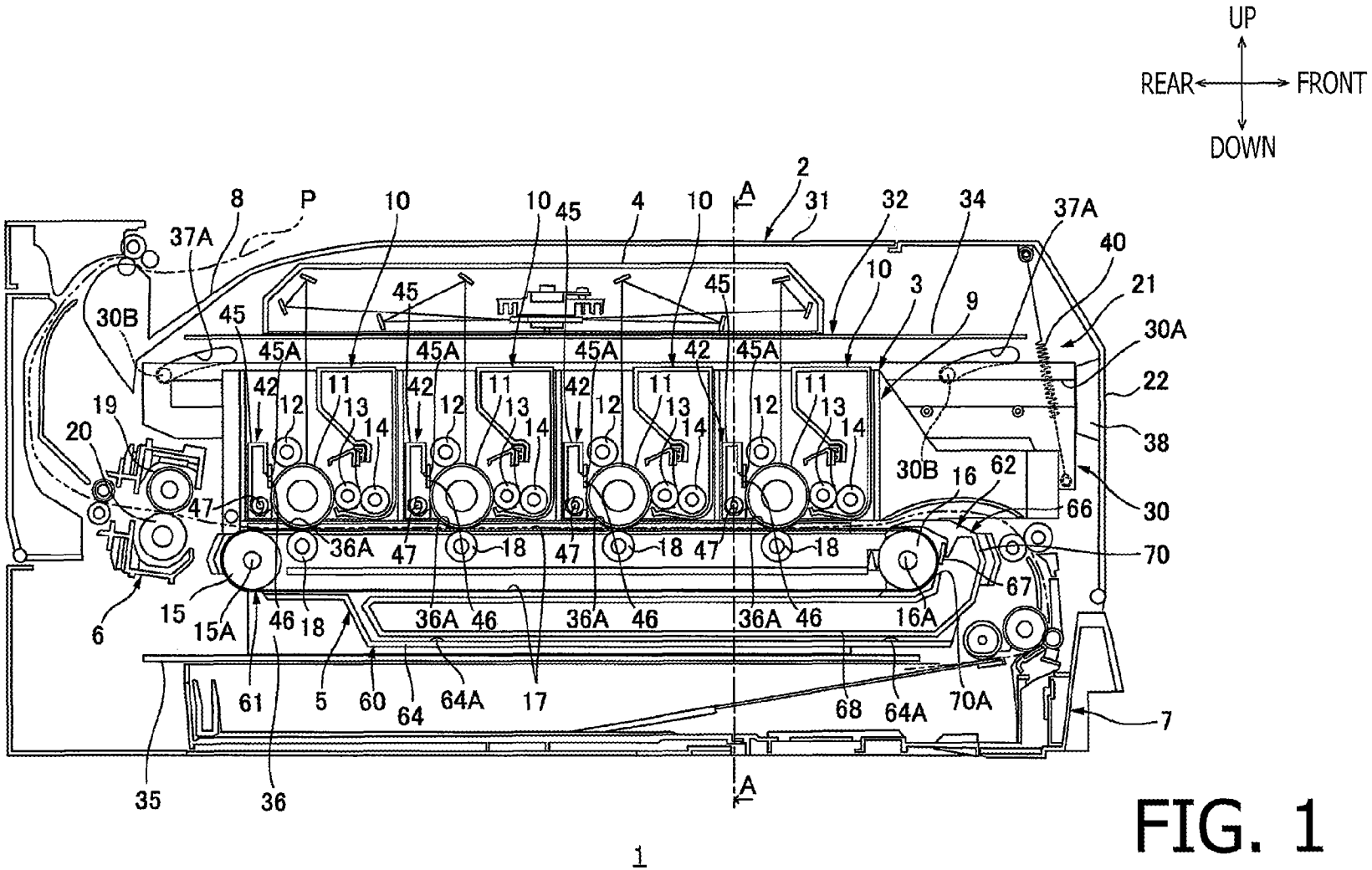
FIG. 1 is a cross-sectional view of an image forming apparatus, taken at a widthwise center, according to a first embodiment of the present disclosure.
Figure 8:
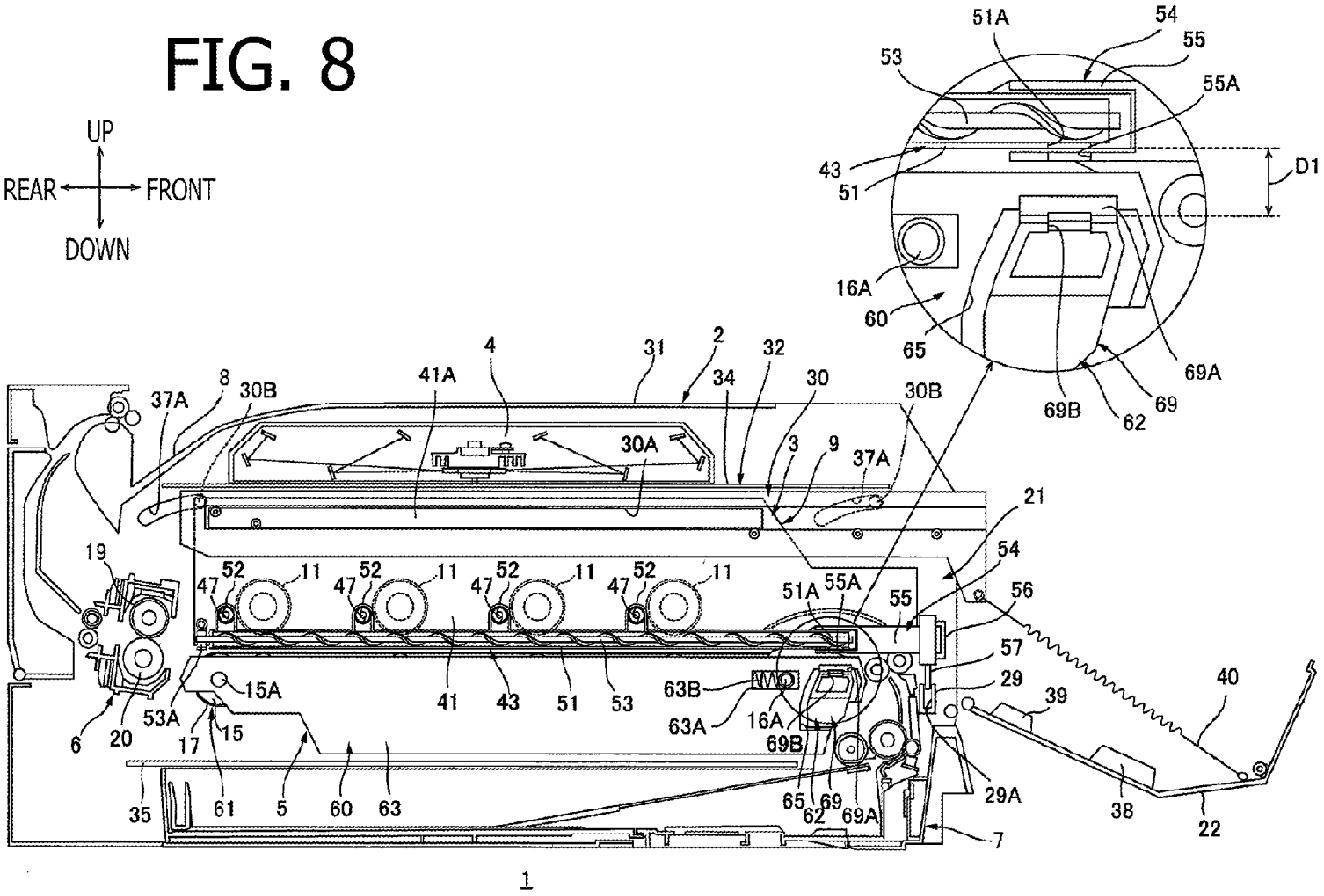

FIG. 8 is a cross-sectional view of the image forming apparatus being in a same condition as the image forming apparatus shown in FIG. 7, at a position equivalent to the line B-B shown in FIG. 1, according to the first embodiment of the present disclosure.

Figure 9:
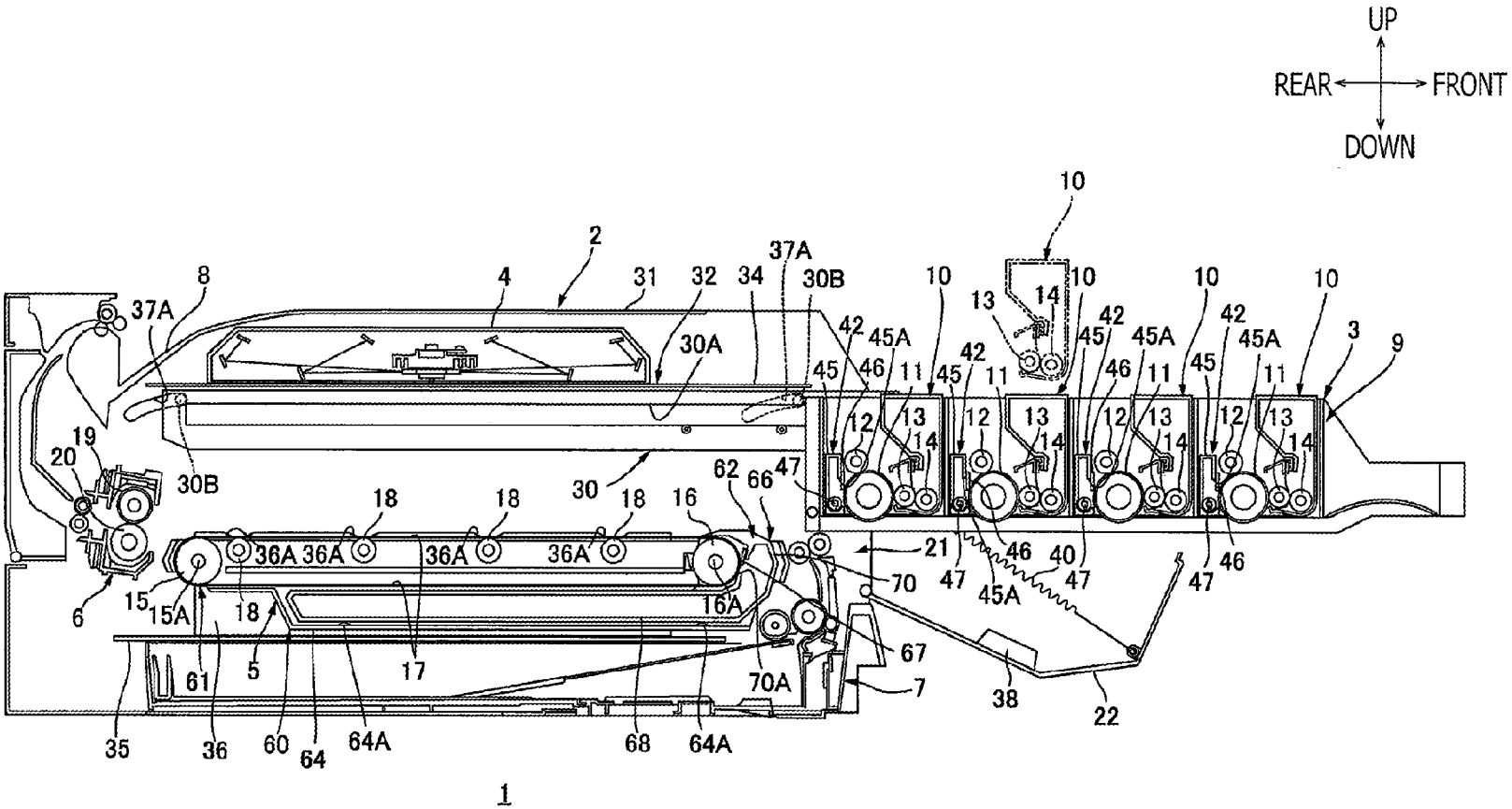

FIG. 9 is a cross-sectional view of the image forming apparatus when the developer cartridge is to be exchanged, with the front cover being in the openable position and the processing unit being in an external position, according to the first embodiment of the present disclosure.

Figure 10:
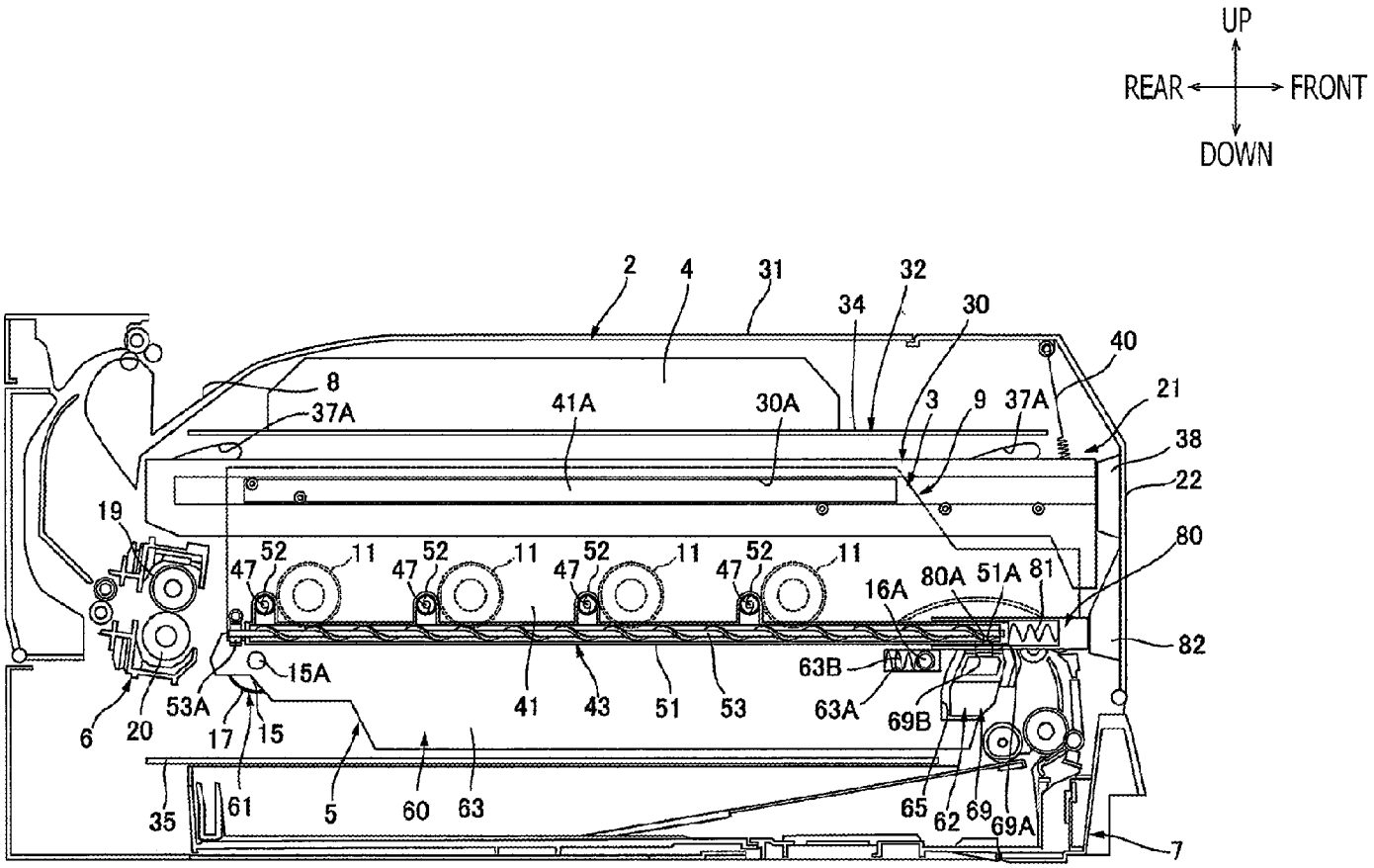

FIG. 10 is an illustrative view of a first modified example of the image forming apparatus, with the front cover being in a closable position and the shutter being in an opening position, according to the first embodiment of the present disclosure.

Figure 11:
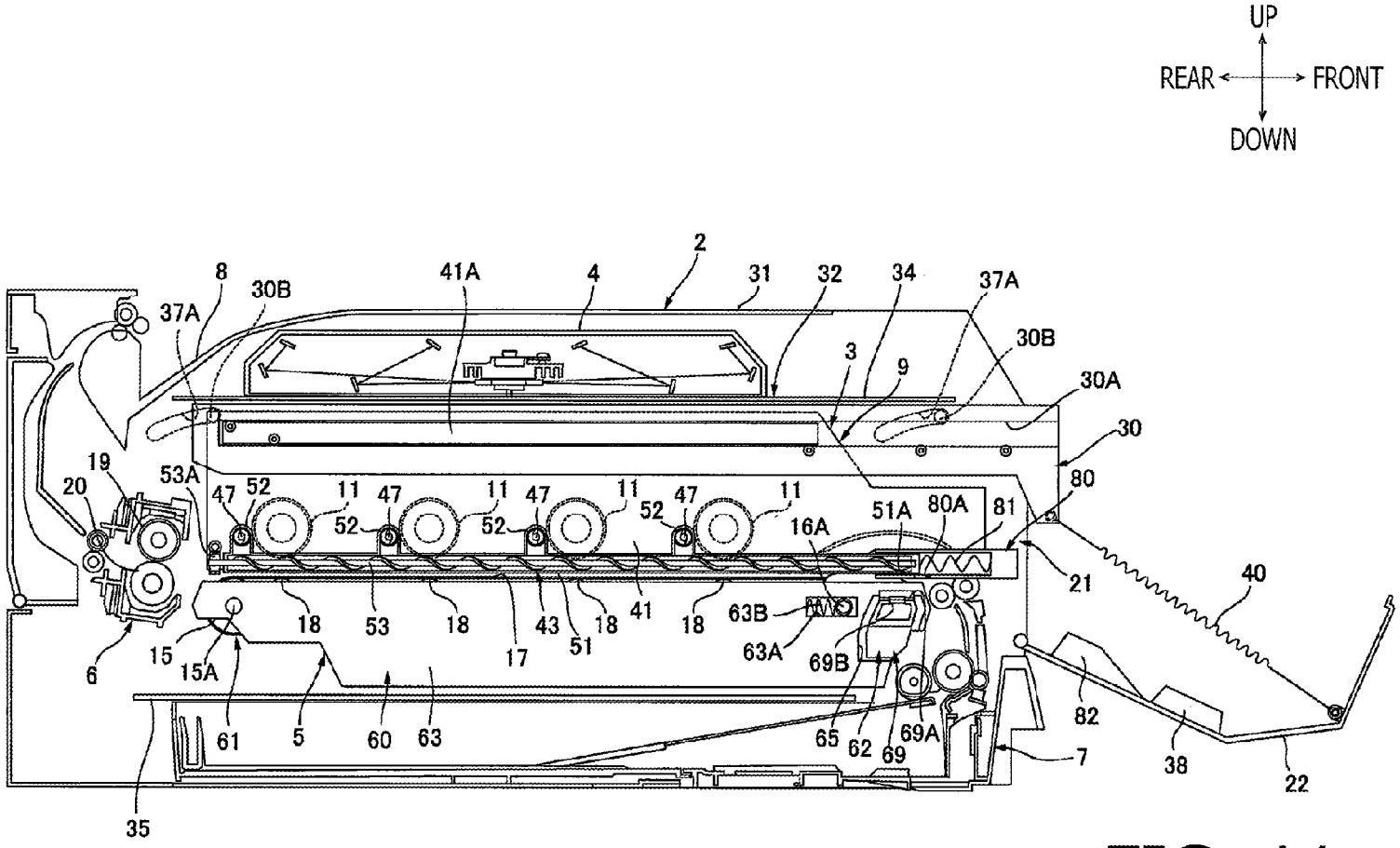

FIG. 11 is another illustrative view of the first modified example of the image forming apparatus, with the front cover being in the openable position and the shutter being in a closable position, according to the first embodiment of the present disclosure.

Figure 12:
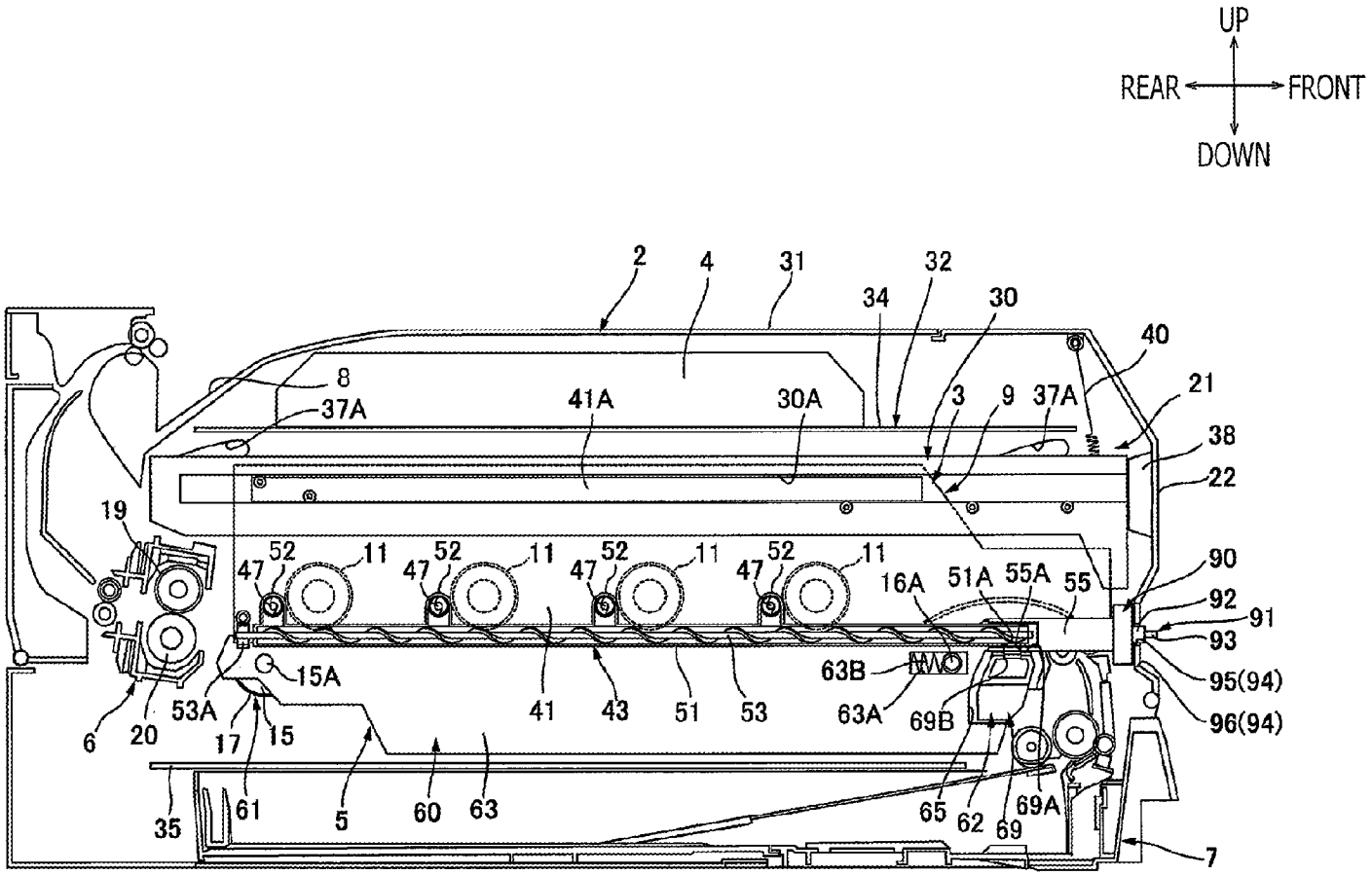

FIG. 12 is an illustrative view of a second modified example of the image forming apparatus, with the front cover being in the closable position and the shutter being in the opening position, according to the first embodiment of the present disclosure.

Figure 13A:
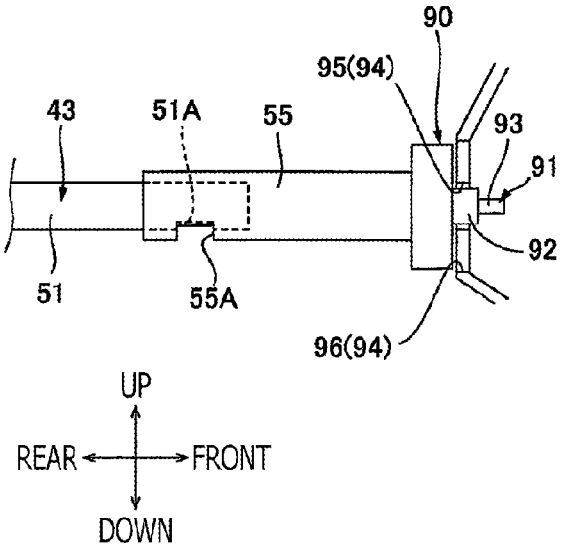
Figure 13B:
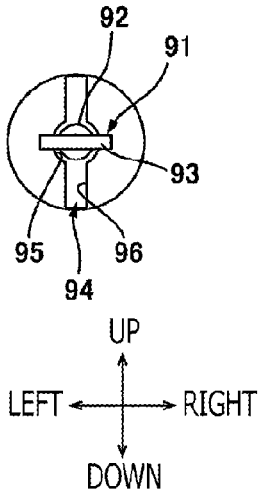
Figure 13C:
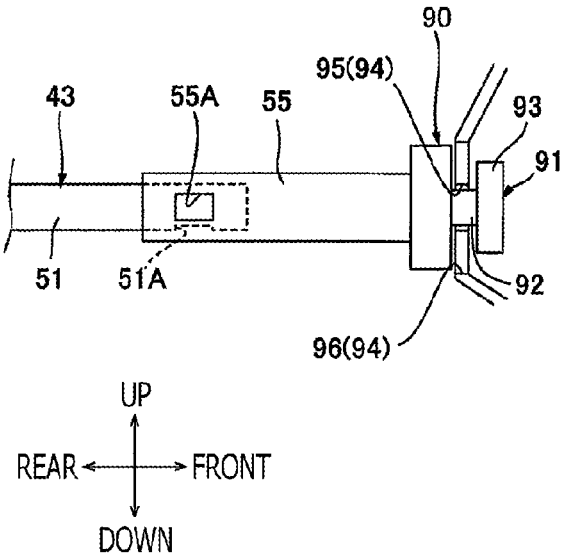
Figure 13D:
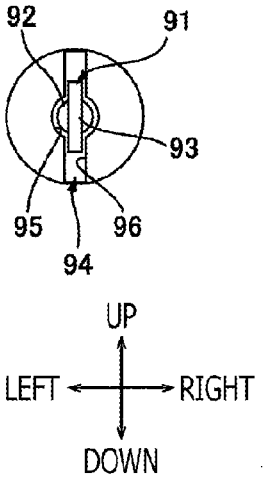

FIG. 13A is an illustrative view of the second modified example of the image forming apparatus, with the shutter being in the opening position, according to the first embodiment of the present disclosure. FIG. 13B is a front view of the handle of the shutter being in the opening position, in the image forming apparatus of the second modified example, according to the first embodiment of the present disclosure. FIG. 13C is an illustrative view of the second modified example of the image forming apparatus, with the shutter being in the closable position, according to the first embodiment of the present disclosure. FIG. 13D is a front view of the handle of the shutter being in the closable position, in the image forming apparatus of the second modified example according to the first embodiment of the present disclosure.

Figure 14:
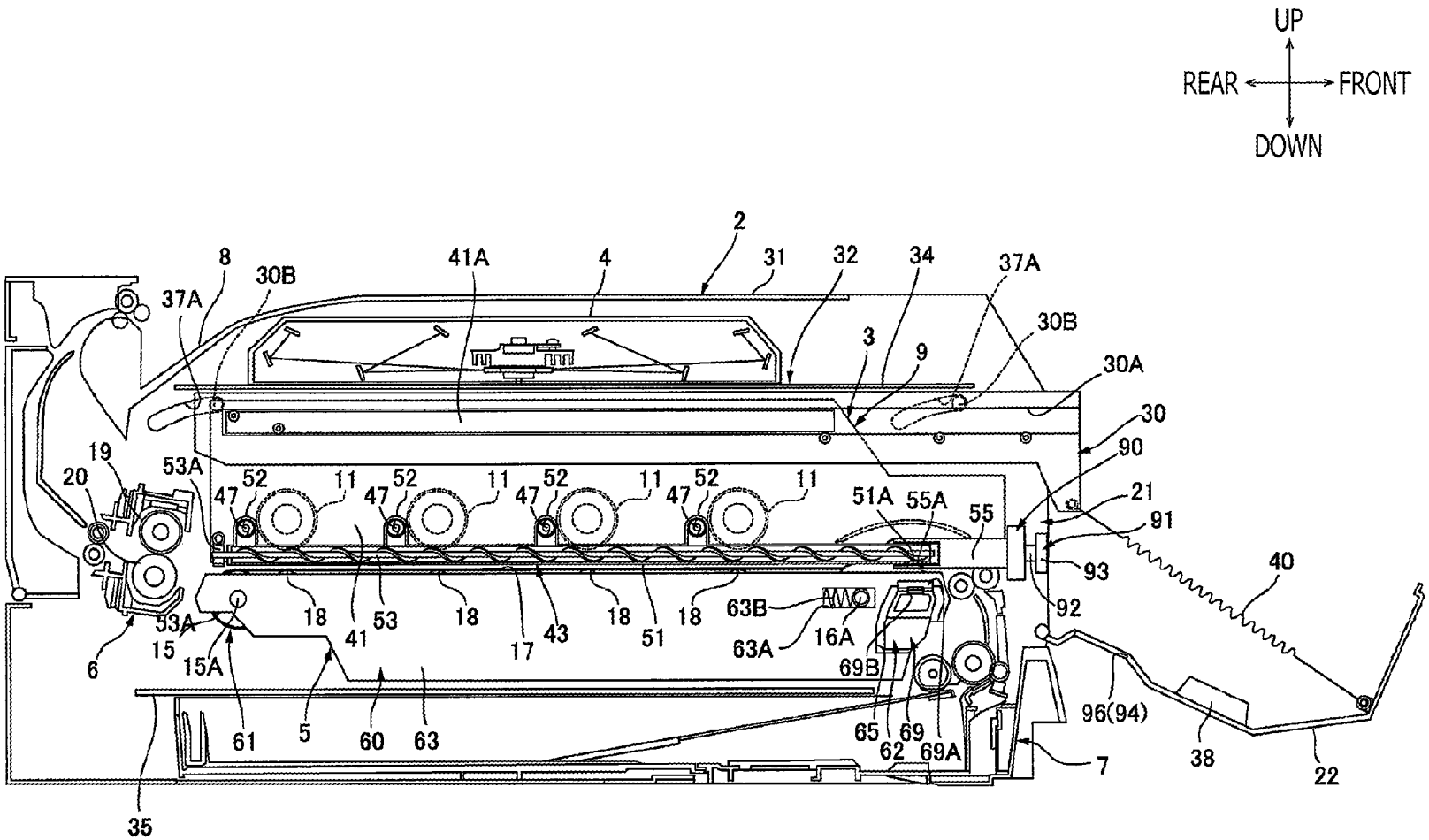

FIG. 14 is another illustrative view of the second modified example of the image forming apparatus, with the front cover being in the openable position and the shutter being in the opening position, according to the first embodiment of the present disclosure.

Figure 15:
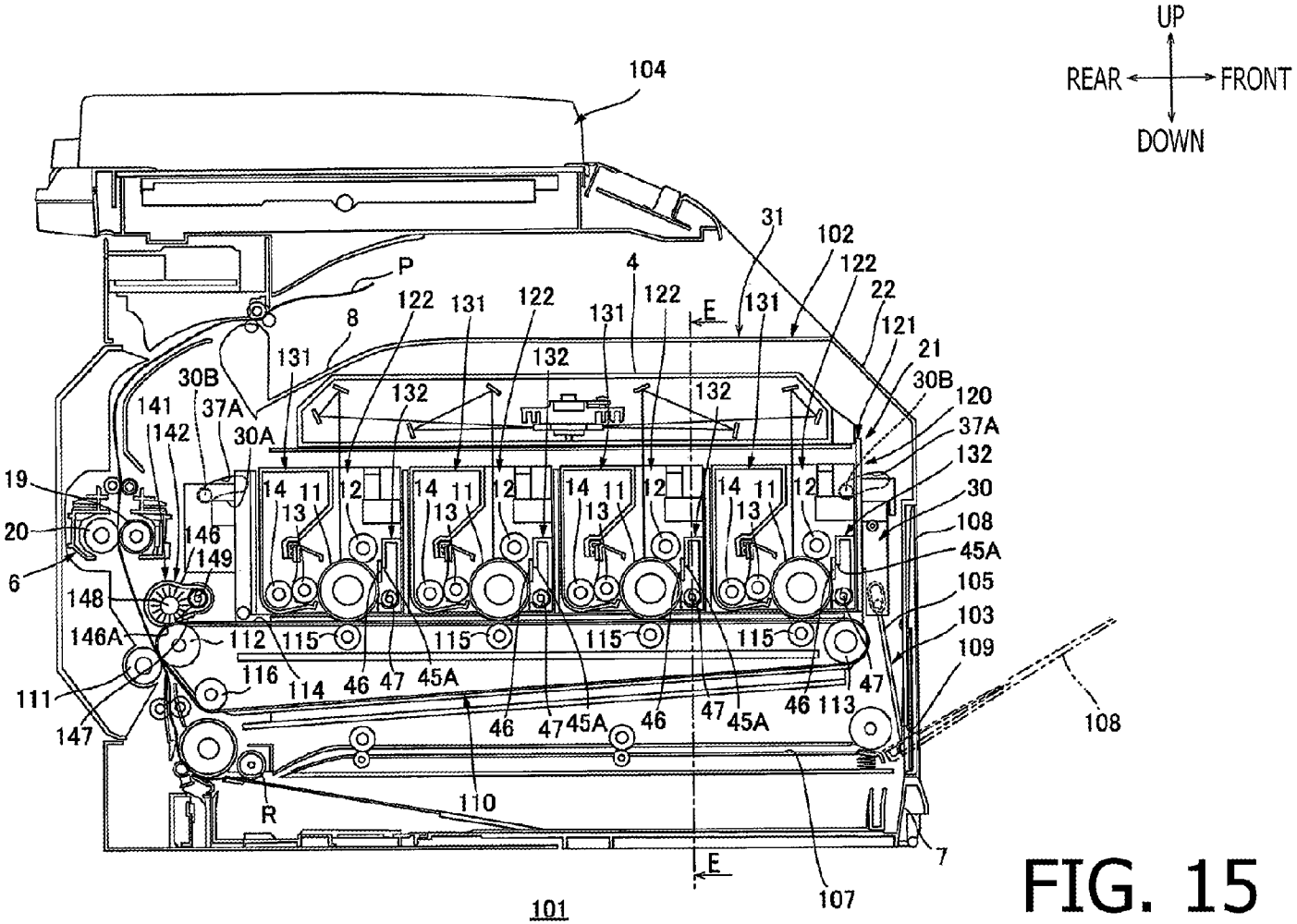

FIG. 15 is a cross-sectional view of an image forming apparatus, taken at a widthwise center, according to a second embodiment of the present disclosure.

Figure 16:
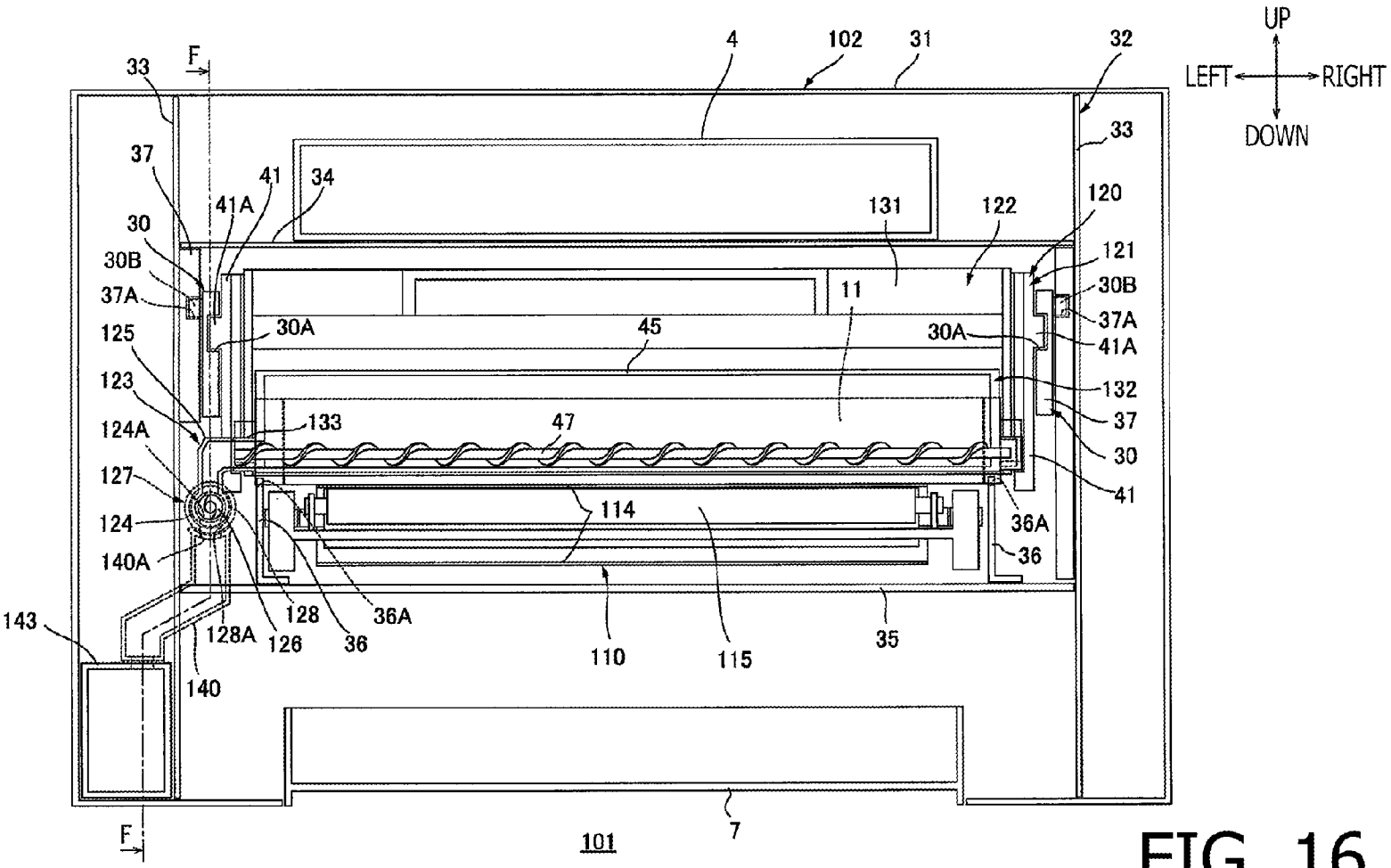

FIG. 16 is a cross-sectional view of the image forming apparatus, taken at a line E-E shown in FIG. 15, according to the second embodiment of the present disclosure.

Figure 17:
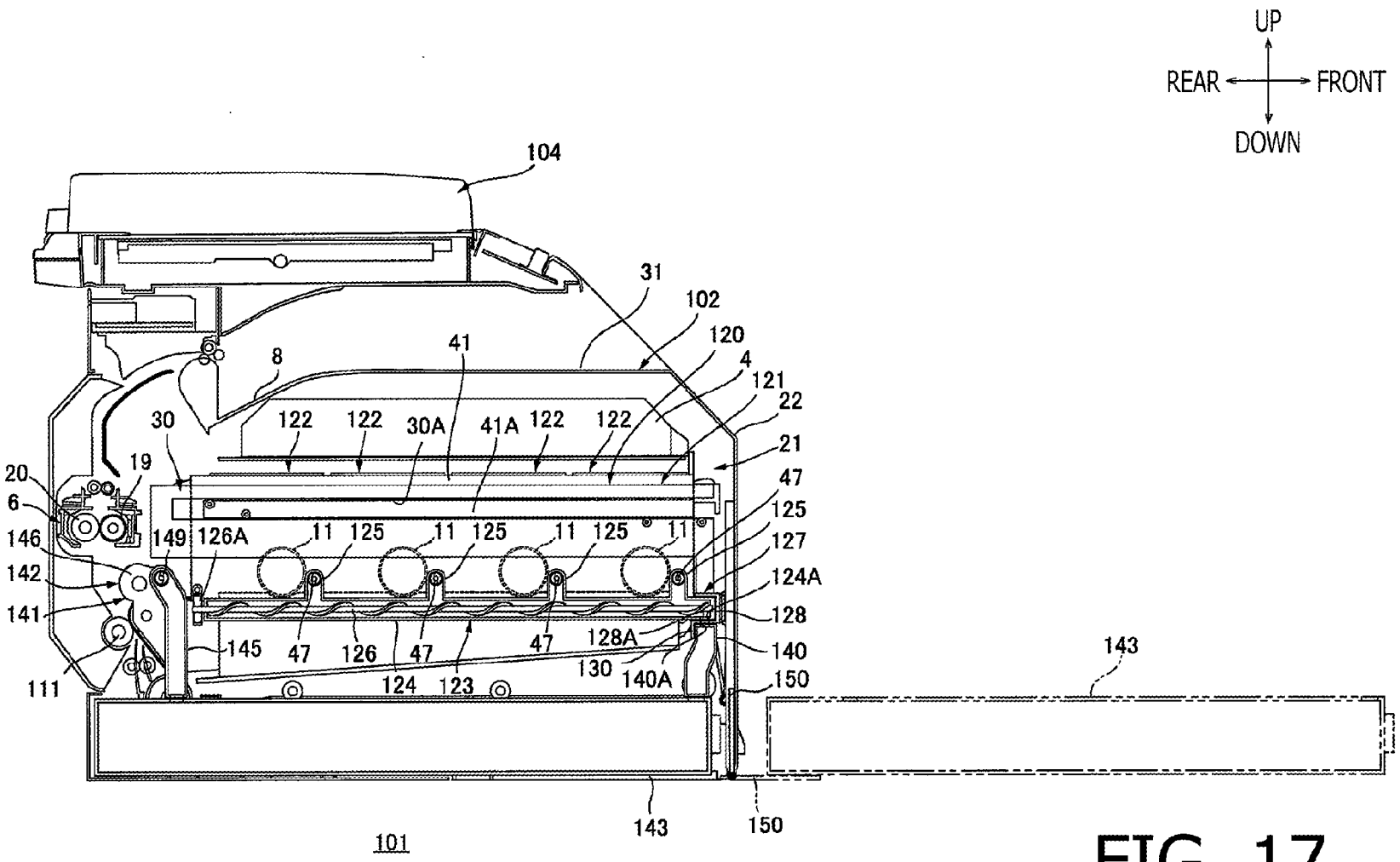

FIG. 17 is a cross-sectional view of the image forming apparatus, taken at a line F-F shown in FIG. 16, according to the second embodiment of the present disclosure.

Figure 18A:
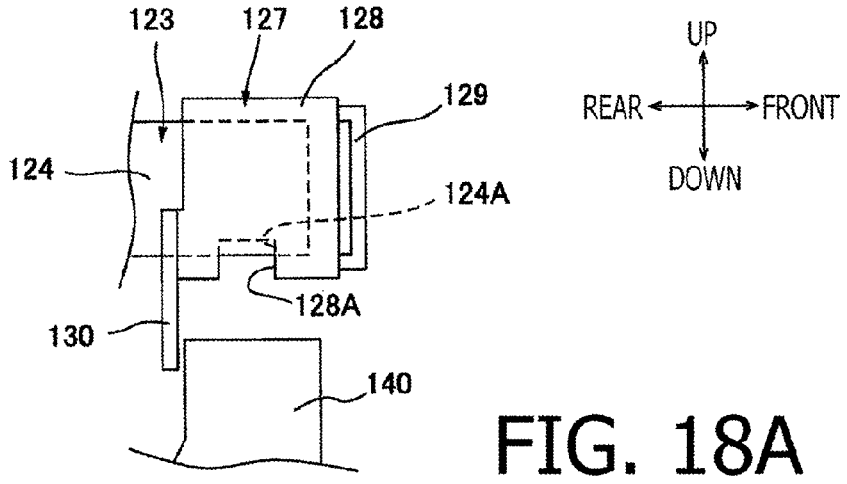
Figure 18B:
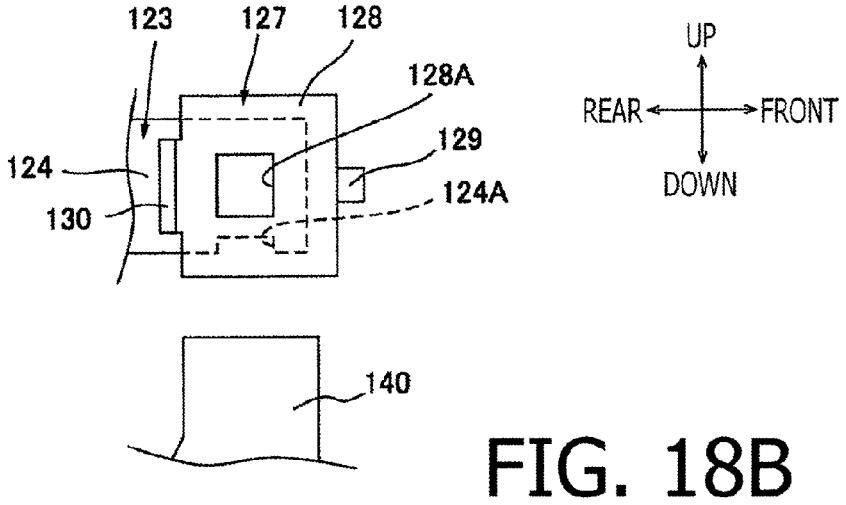

FIG. 18A illustrates the shutter in the opening position in the image forming apparatus according to the second embodiment of the present disclosure. FIG. 18B illustrates the shutter in the closable position in the image forming apparatus according to the second embodiment of the present disclosure.

Figure 19:
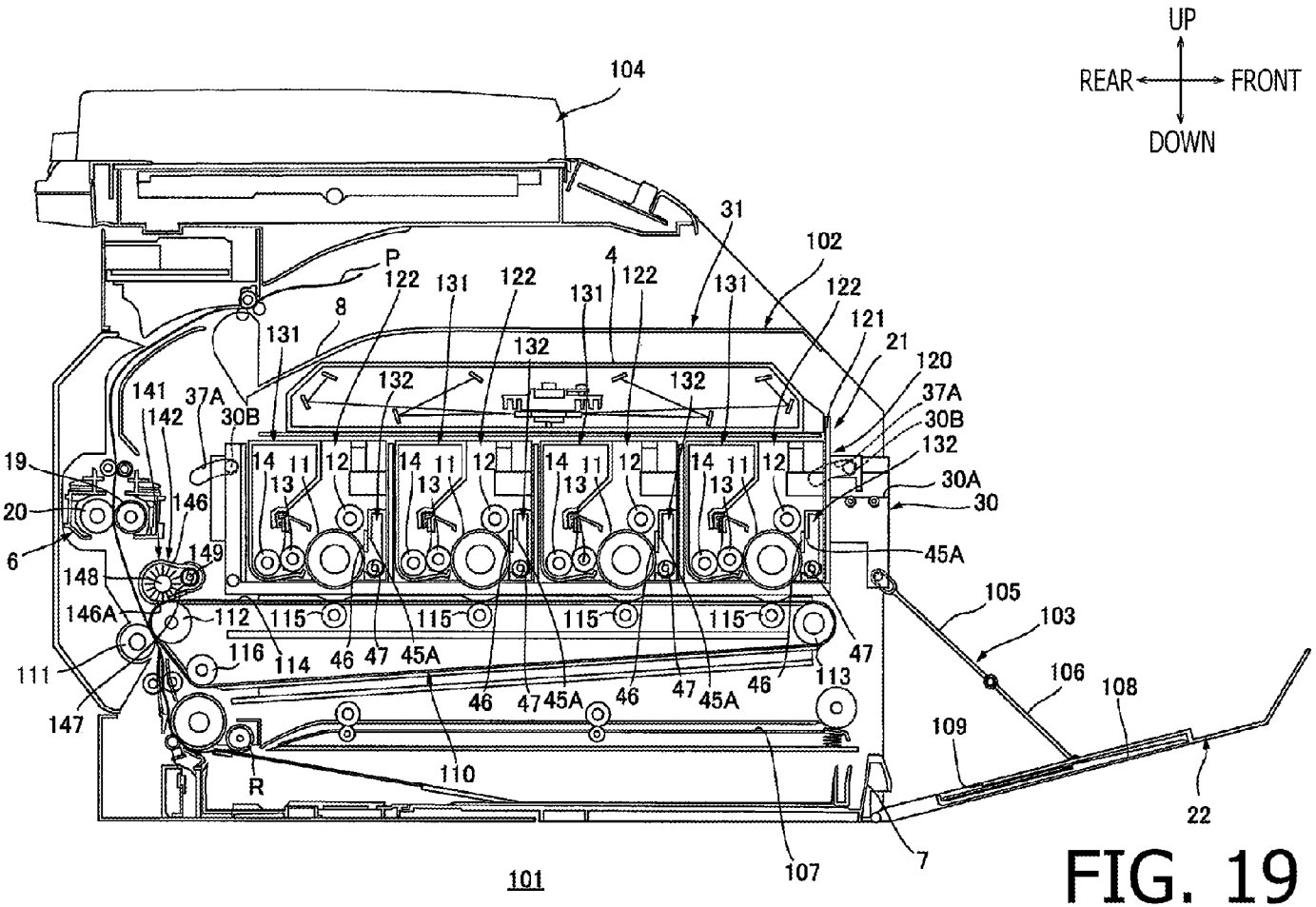

FIG. 19 is a cross-sectional view of the image forming apparatus when a developer cartridge is to be exchanged, with the front cover being in the openable position and the processing unit being in the separated position, according to the second embodiment of the present disclosure.

Figure 20:
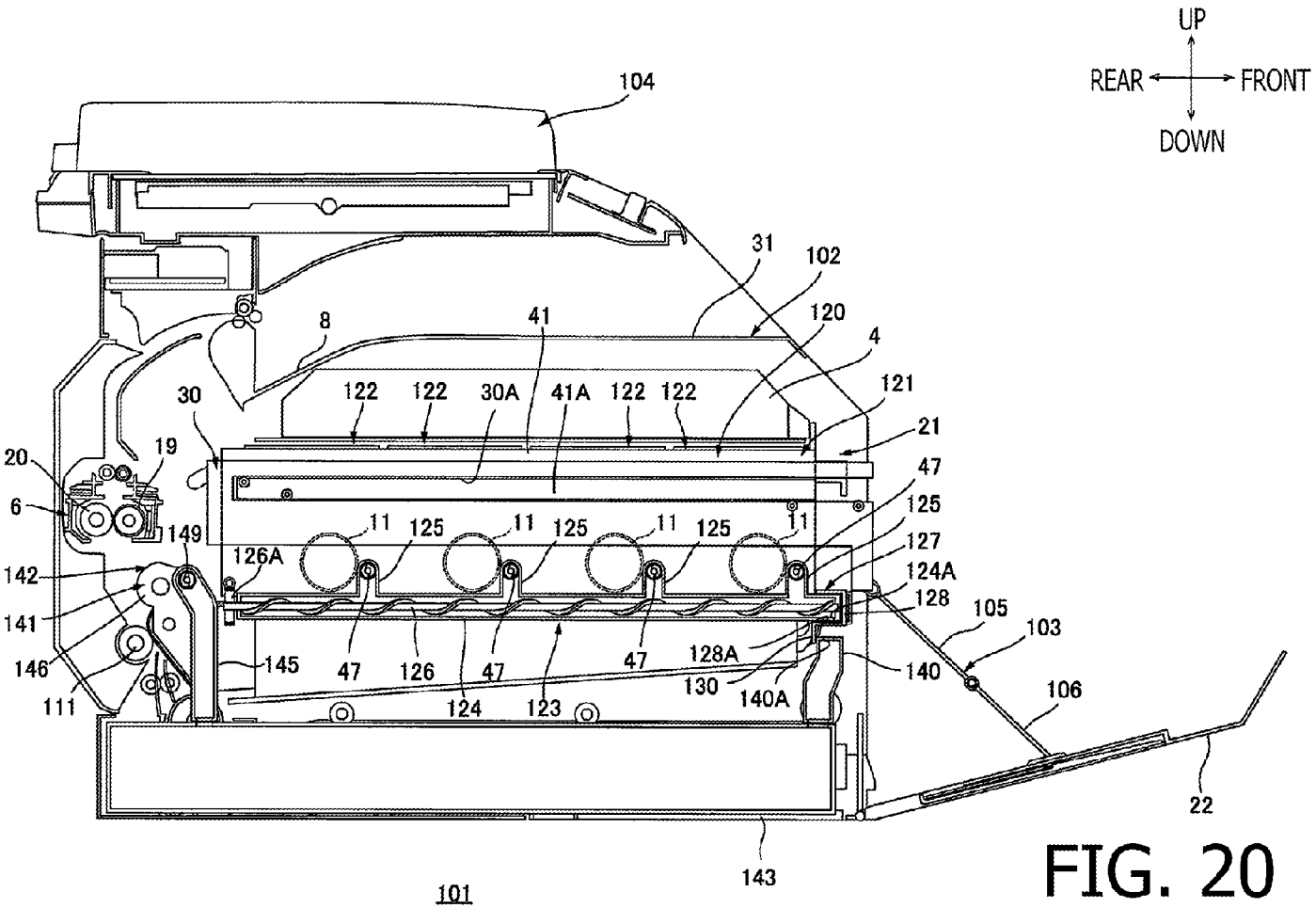

FIG. 20 is a cross-sectional view of the image forming apparatus being in a same condition as the image forming apparatus shown in FIG. 19, at a position equivalent to the line F-F shown in FIG. 19, according to the second embodiment of the present disclosure.

Figure 21:
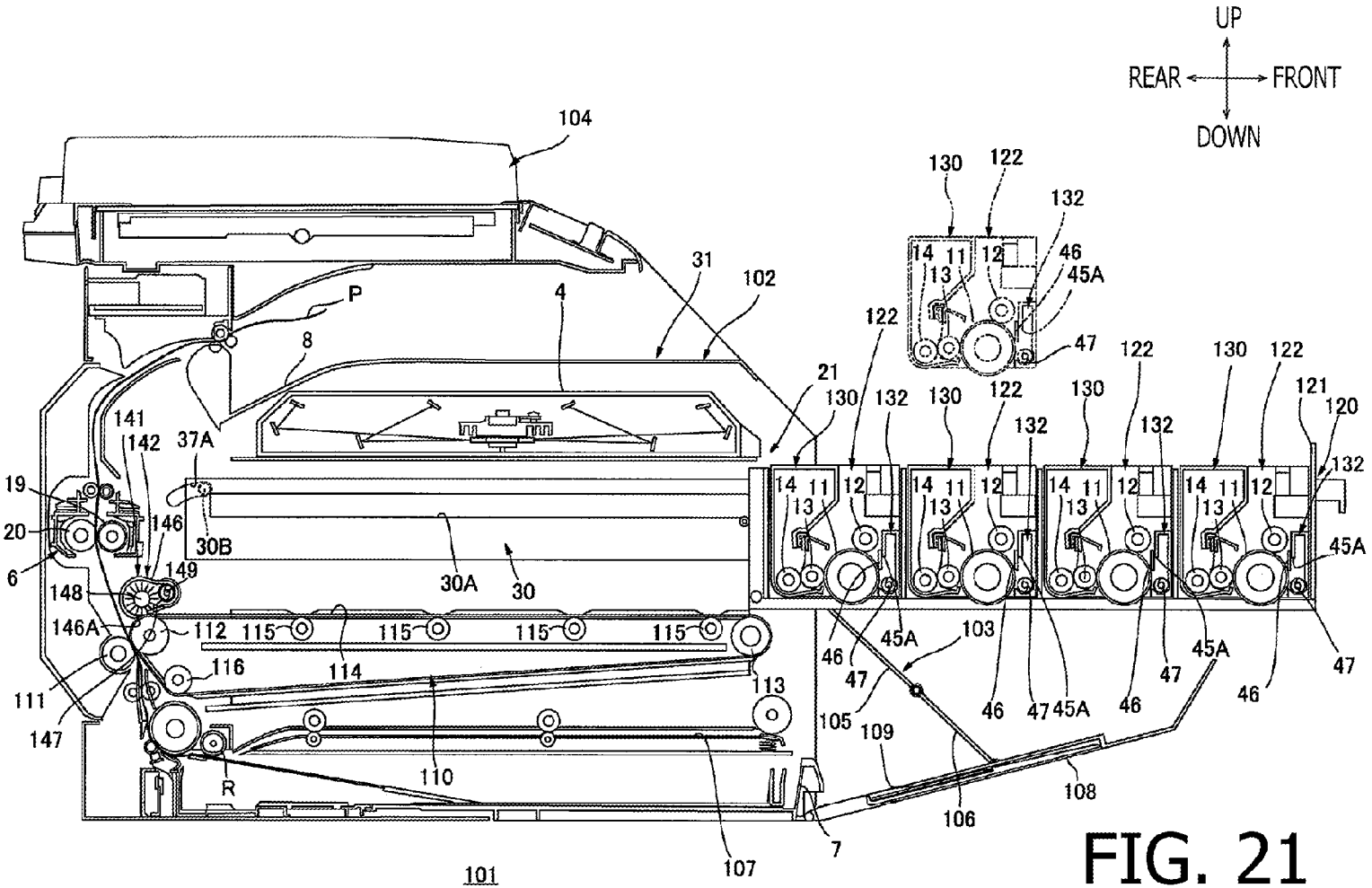

FIG. 21 is a cross-sectional view of the image forming apparatus when the developer cartridge is to be exchanged, with the front cover being in the openable position and the processing unit being in the external position, according to the second embodiment of the present disclosure.

DETAILED DESCRIPTION

Hereinafter, illustrative embodiments of the present disclosure will be described with reference to the accompanying drawings.

1. Overall Configuration of Image Forming Apparatus

An image forming apparatus 1 according to a first embodiment of the present disclosure is a direct tandem-typed color laser printer (see FIG. 1). In the following description, directions concerning the image forming apparatus 1 and elements included in the image forming apparatus 1 will be based on a user's ordinary usable posture and position to use the image forming apparatus 1, when the image forming apparatus 1 is laid horizontally, and referred to in accordance with orientation indicated by arrows in each drawing. Therefore, for example, an upward direction and a downward direction in FIG. 1 correspond to an upward direction and a downward direction respectively for the user, and a rightward direction and a leftward direction in FIG. 1 correspond to a frontward direction and a rearward direction respectively for the user. A right-hand side and a left-hand side for the user facing a front face of the image forming apparatus 1 is defined as right and left respectively. Therefore, a nearer side in FIG. 1 is the left-hand side, and a farther side in FIG. 1 is the right-hand side. A right-to-left or left-to-right direction of the image forming apparatus 1 may also be referred to as a widthwise direction or a lateral direction. The front-to-rear or rear-to-front direction may be referred to as a front-rear direction or a direction of depth. Furthermore, directions of the drawings in FIGS. 2-21 are similarly based on the orientation of the image forming apparatus 1 as defined above and correspond to those with respect to the image forming apparatus 1 shown in FIG. 1 even when the image forming apparatus 1 in the drawings is viewed from different angles.

The image forming apparatus 1 includes a body 2, a processing unit 3, a scanner unit 4, a transfer unit 5, and a fixing unit 6.

The body 2 is formed to have an approximate shape of a rectangular box and includes an aperture 21, a front cover 22, a feeder tray 7, and a sheet outlet tray 8.

The aperture 21 is located on a front face of the body 2 and is formed through the front face of the body 21 along the front-rear direction to allow communication between the interior and the exterior of the body 2 so that the processing unit 3 may be installed inside the body through the aperture 21.

The front cover 22 is located at a frontward position of the body 2 and has an approximate shape of a flat plate. The front cover 22 may be arranged to stand along the vertical direction and supported by the front face of the body 2 at a lower end thereof to be swingable frontward about the lower end. Thus, the front cover 22 is swingable between an openable position (see FIG. 7), at which the aperture 21 is exposed, and a closable position (see FIG. 1), at which the aperture 21 is covered.

The feeder tray 7 is located at a lower position in the body 2 and may accommodate sheets P being transcription media therein.

The sheet outlet tray 7 is formed on an upper face of the body 2 to dent downward from the upper face so that the sheets P may be stacked thereon.

The processing unit 3 may be accommodated inside the body 2 through the aperture 21 to be located in a central area in the body 2. The processing unit 3 is movable inside the body 2 between a contacting position (see FIG. 1), at which a plurality of photosensitive drums 11 contact a conveyer belt 17, and a separated position (see FIG. 7), which is an upper position with respect to the contacting position and at which the photosensitive drums 11 are separated from the conveyer belt 17, while the processing unit 3 is accommodated inside the body 2. The photosensitive drums 11 and the conveyer belt 17 will be described later in detail. Further, the processing unit 3 is movable along the front-rear direction between the separated position and an external position (see FIG. 9), which is a position extended frontward with respect to the separated position and outside the body 2, through the aperture 21. Thus, when the processing unit 3 is accommodated inside the body 2, the processing unit 3 may be pushed rearward through the aperture 21. The processing unit 3 includes a drum unit 9 and a plurality of developer cartridges 10.

The drum unit 9 includes the plurality of photosensitive drums 11 and a plurality of charger rollers 12.

The photosensitive drums 11 are rotatably supported by a lower part of the processing unit 3. Each of the photosensitive drums 11 is arranged to correspond to one of the colors of yellow, magenta, cyan, and black. The photosensitive drums 11 are arranged to be spaced apart from one another to align along the front-rear direction, from the front toward the rear, in an order of, for example, yellow, magenta, cyan, and black, respectively. The photosensitive drums 11 are each formed to have a cylindrical shape, which longitudinally aligns along the widthwise direction. In other words, the axes of the photosensitive drums 11 extend in the widthwise direction.

Each of the charger rollers 12 is arranged to correspond to one of the photosensitive drums 11 and is arranged in an upper-rearward position with respect to the corresponding one of the photosensitive drums 11. Each charger roller 12 is arranged to contact an upper-rear part of the corresponding one of the photosensitive drums 11.

Each of the developer cartridges 10 is arranged to correspond to one of the photosensitive drums 11 in a frontward position with respect to the corresponding one of the photosensitive drums 11. The developer cartridges 10 each includes a developer roller 13 and a supplier roller 14, and contains toner in one of the corresponding colors in an upper area thereof with respect to the developer roller 13 and the supplier roller 14.

The developer roller 13 is rotatably supported by a corresponding one of the developer cartridges 10 to be exposed rearward at a lower position in the developer cartridge 10. The developer roller 13 is arranged to contact a frontward end of the corresponding one of the photosensitive drums 11.

The supplier roller 14 is arranged in a frontward position with respect to the developer roller 13 to contact a frontward end of the developer roller 13.

The scanner unit 4 is located in an upper position with respect to the processing unit 3. The scanner unit 4 may emit laser beams, as indicated by solid lines in FIG. 1, toward the photosensitive drums 11 according to image data so that the photosensitive drums 11 are selectively exposed to the laser beams according to the image data.

The transfer unit 5 is located in a lower position with respect to the processing unit 3. The transfer unit 5 includes a driving roller 15, a driven roller 16, the conveyer belt 17, and a plurality of transfer rollers 18.

The driving roller 15 is located in a rearward position in the transfer unit 5.

The driven roller 16 is located in a frontward and spaced-apart position with respect to the driving roller 15 in the transfer unit 5 to face with the driving roller 15.

The conveyer belt 17 is strained around the driving roller 15 and the driven roller 16, and is arranged to contact each one of the photosensitive drums 11 at an upper part thereof. The conveyer belt 17 is rolled along with rotation of the driving roller 15 and the driven roller 16 to circulate in a direction to move the upper part rearward and a lower part frontward.

Each of the transfer rollers 18 is arranged to correspond to one of the photosensitive drums 11 in a lower position with respect to the corresponding one of the photosensitive drums 11 so that the upper part of the conveyer belt 17 is placed in between the photosensitive drums 11 and the transfer rollers 18.

The fixing unit 6 is located in a rearward position with respect to the transfer unit 5. The fixing unit 6 includes a heat roller and a pressure roller 20. The pressure roller 20 is arranged to contact the heat roller 19.

When the image forming apparatus 1 starts forming an image, the charger rollers 12 charge the surfaces of the photosensitive drums 11 evenly, and the scanner unit 4 emits the laser beams toward the photosensitive drums 11 selectively according to the image data so that electrostatic latent images are formed in the areas selectively exposed to the laser beams on the photosensitive drums 11.

Meanwhile, the supplier rollers 14 supply the toner in the developer cartridges 10 to the developer rollers 13. The toner supplied to each developer roller 13 is frictionally charged between the developer roller 13 and the supplier roller 14 and carried on the developer roller 13.

The developer rollers 13 then supply the toner to the electrostatic latent images on the photosensitive drums 11. Thus, toner images are formed on the surfaces of the photosensitive drums 11.

In the meantime, sheets P in the feeder tray 7 are picked up one-by-one along with rotation of the rollers. Each sheet P is conveyed upper-frontward and turned upper-rearward to be conveyed to an intermediate position between the photosensitive drum 11 at a most frontward position and the conveyer belt 17. Thereafter the sheet P is conveyed rearward by the conveyer belt 17. The toner images on the photosensitive drums 11 are transferred onto the sheet P sequentially as the sheet P proceeds through an intermediate position between each photosensitive drum 11 and transfer roller 18.

The sheet P is thereafter exposed to heat and pressure from the heat roller 19 and the pressure roller 20 when the sheet P passes through an intermediate position between the heat roller 19 and the pressure roller 20 so that the image is fixed thereon. The sheet P is thereafter discharged to the sheet outlet tray 8.

2. Detailed Configuration of the Image Forming Apparatus

Figure 3:
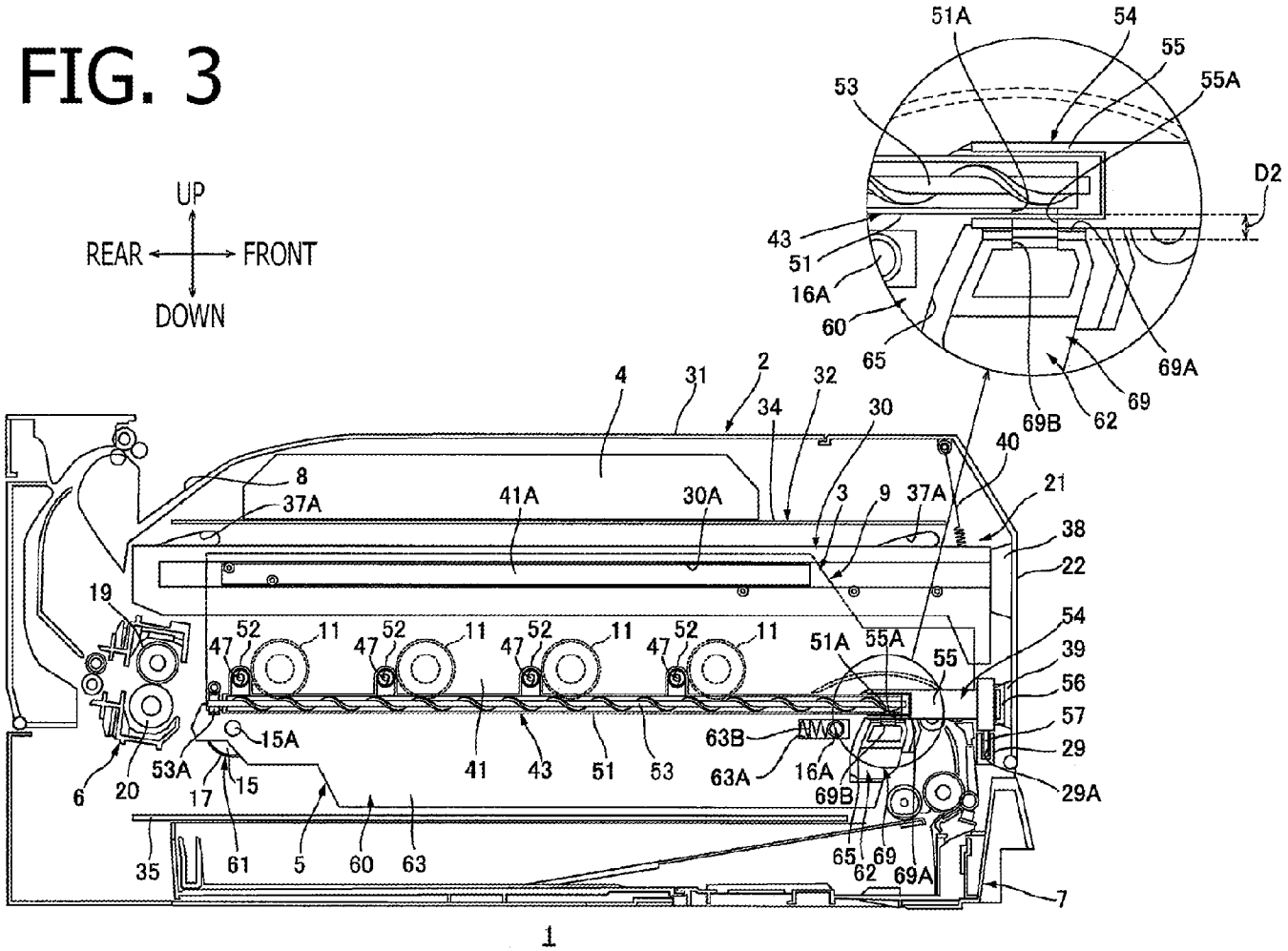
FIG. 3 is a cross-sectional view of the image forming apparatus, taken at a line B-B shown in FIG. 2, according to the first embodiment of the present disclosure.

The body 2 of the image forming apparatus 1 includes, as shown in FIGS. 2-3, an outer frame 31, an inner frame 32, a pair of lifts 30, a slide-restrictive piece 29, and the front cover 22.

The outer frame 31 forms an exterior housing of the image forming apparatus 1 and has an approximate shape of a box. The outer frame 31 may be made of, for example, hard resin.

The inner frame 32 is located inside the outer frame 31. The inner frame 32 has an approximate shape of a sleeve, of which front end and rear end are open, and longitudinally aligns along the front-rear direction. The inner frame 32 includes a pair of lateral plates 33, a pair of guide members 37, an upper plate 34, a lower plate 35, and a pair of drum positioning members 36.

The lateral plates 33 are arranged to be spaced apart from each other on a laterally inner side of right and left side walls of the outer frame 31. The lateral plates 33 each has a shape of a plate standing vertically and may be made of metal such as stainless steel.

The guide members 37 are each supported on an inner surface of an upper part of each lateral plate 33. Each guide member 37 has a shape of a plate standing vertically and may be made of, for example, hard resin. Each guide member 37 has a plurality of, for example, two (2), guide grooves 37A.

The guide groove 37A is formed on a frontward end and a rearward end of each guide member 37. Each guide groove 37A is formed to dent laterally outward from an inner surface of the guide member 37 and is extended to curve upper-frontward, or lower-rearward.

The upper plate 34 is located in a lower and spaced-apart position with respect to a top part of the outer frame 31. The upper plate 34 may be made of metal such as stainless steel and has a shape of a flat plate spreading along the widthwise direction. The upper plate 34 is arranged to bridge a gap between upper ends of the paired lateral plates 33. The upper plate 34 supports the scanner unit 4, which is placed on the upper plate 34.

The lower plate 35 is arranged in a lower position in the inner frame 32. The lower plate 35 is located in an upper and spaced-apart position with respect to a bottom part of the outer frame 31. The lower plate 35 may be made of metal such as stainless steel and has a shape of a flat plate spreading along the widthwise direction. The lower plate 34 is arranged in an upper position with respect to the feeder tray 7 to bridge a gap between lower ends of the paired lateral plates 33.

The paired drum-positioning members 36 are arranged to be spaced apart from each other on a laterally inner side of the lateral plates 33. Each drum-positioning member 36 has a shape of a plate standing vertically. The drum-positioning members 36 may be made of metal such as stainless steel. The drum-positioning members 36 are fixed to an upper surface of the lower plate 35 at lower ends thereof. The drum-positioning members 36 are each formed to have a plurality of positioning dents 36A (see FIG. 1).

The positioning dents 36A in each drum-positioning member 36 are, as shown in FIGS. 1-2, arranged to be evenly spaced apart from each other along the front-rear direction in positions corresponding to the positions of the photosensitive drums 11. The positioning dents 36A are formed to dent downward from an upper edge of the drum-positioning member 36 in a shape of a U, which is open upward. The photosensitive drums 11 are each arranged to have widthwise ends thereof to fit in the corresponding ones of positioning dents 36A.

The paired lifts 30 are, as shown in FIGS. 2-3, arranged on a laterally inner side of the paired guide members 37. Each of the lifts 30 has a shape of a plate, which spreads along the front-rear direction. The lifts 30 each has a guide groove 30A and an engageable boss 30B.

The guide groove 30A is formed to dent outward along the widthwise direction from an inner surface of each lift 30 and to stretch longitudinally along the front-rear direction.

The engageable bosses 30B are each formed on a front end and a rear end of the lift 30 respectively. Each engageable boss 30B has a cylindrical shape, which protrudes outward from an outer surface of the lift 30 along the widthwise direction. The engageable boss 30B is arranged to slidably fit in the guide groove 37A in the guide member 37.

The slide-restrictive piece 29 is located in a frontward area in the body 2 at a frontward position with respect to the transfer unit 5. The slide-restrictive piece 29 is in a shape of a block stretching vertically and has a slit 29A.

The slit 29A is formed and deepened to dent downward from a top surface of the slide-restrictive piece 29 to have a shape of a U, in a lateral view, which is open upward. A dimension (depth) of the slit 29A in the vertical direction is greater than a distance for the drum unit 9 to move between the contacting position and the separated position.

The front cover 22 includes a pair of lift-restrictive pieces 38, a shutter-restrictive piece 39, and a pair of tension springs 40.

The paired lift-restrictive pieces 38 are each arranged on a widthwise end of the front cover 22 at an intermediate height of the front cover 22 along the vertical direction. Each lift-restrictive piece 38 is formed to protrude rearward from a rearward face of the front cover 22, when the front cover is in the closable position. The lift-restrictive pieces 38 each has a shape of a quadrilateral plate, in a lateral view, and is arranged to face with a front end of each lift 30, when the front cover is in the closable position, to restrict the lift 30 from moving frontward.

The shutter-restrictive piece 39 is, as shown in FIGS. 3 and 4A, located at a lower-leftward end of the front cover 22. The shutter-restrictive piece 39 has a shape of a block and arranged to protrude rearward from the rear face of the front cover 22. The shutter-restrictive piece 39 includes a grove 39A and a blocker 39B.

The groove 39A is located in a widthwise central position in the shutter-restrictive piece 39. The groove 39A is formed to dent frontward from a rearward face of the shutter-restrictive piece 39 and to stretch longitudinally along the vertical direction.

The blocker 39B is located at each widthwise end of the shutter-restrictive piece 39. The blocker 39B is formed to project rearward from the rear face of the front cover 22 and to stretch longitudinally along the vertical direction. The blockers 39B form lateral walls of the groove 39A.

The paired tension springs 40 are coiled springs and are supported by the front cover 22 at upper and widthwise ends of the front cover 22. Each of the tension springs 40 is anchored to the upper and widthwise ends of the front cover 22 at one end thereof, and the other end of the tension spring 40 is anchored to a lower-front end of each lift 30.

3. Detailed Configuration of the Drum Unit

The drum unit 9 has, as shown in FIGS. 1-2, a form of a frame, which is open upward, downward, and sideward. The drum unit 9 includes a pair of lateral plates 41, a plurality of drum cleaners 42, and a waste toner conveyer 43.

3-1. Lateral Plates

The paired lateral plates 41 are located at widthwise ends of the drum unit 9. Each lateral plate 41 has a shape of a plate, which stands vertically, and has a protrusive strip 41A.

The protrusive strip 41A is located at an upper end of each lateral plate 41 and is formed to protrude outward along the widthwise direction from an outer surface of the lateral plate 41 and to stretch longitudinally along the front-rear direction. The protrusive strips 41A are placed to slidably fit in the guide grooves 30A in the lifts 30.

3-2. Drum Cleaners

Each of the drum cleaners 42 is arranged in a rearward position with respect to corresponding one of the photosensitive drums 11 between the paired lateral plates 41. Each drum cleaner 42 includes a cleaner-frame 45, a cleaning blade 46, and a screw 47.

The cleaner-frame 45 has a shape of a box, which stretches longitudinally in the widthwise direction and has an opening 45A.

The opening 45A is formed through a frontward part of the cleaner-frame 45 along the front-rear direction and is elongated along the widthwise direction. The opening 45A is formed in a position to coincide with the rearward end of the photosensitive drum 11 along the front-rear direction.

The cleaning blade 46 is located in a frontward position with respect to the opening 45A. The cleaning blade 46 has a shape of a plate, which stands along the vertical direction. An upper end of the cleaning blade 46 is fixed to an upper edge of the opening 45A on a front face of the cleaner-frame 45. The cleaning blade 46 is arranged to have a lower edge thereof to contact the rearward end of the photosensitive drum 11.

The screw 47 is located in a lower position in the cleaner-frame 45. The screw 47 is an auger screw, which aligns longitudinally along the widthwise direction. The screw 47 is arranged to have a rightward end thereof to penetrate through a right-side wall of the cleaner-frame 45 and through the lateral plate 41 of the drum unit 9 on the right to protrude further rightward than the lateral plate 41 on the right. The rightward end of the screw 47 is rotatably supported by the right-side wall of the cleaner-frame 45. The screw 47 includes a gear 47A.

The gear 47A is supported on the rightward end of the screw 47 in an outward (rightward) position with respect to the lateral plate 41 on the right. The gear 47 is not rotatable with respect to the screw 47 but is rotatable integrally with the screw 47. A driving force generated in the body 2 of the image forming apparatus 1 is transmitted to the gear 47A through a gear train, which is not shown, to rotate the screw 47.

3-3. Waste Toner Conveyer

The waste toner conveyer 43 is, as shown in FIGS. 2-3, located in a lower position in the drum unit 9 on an outer (leftward) side of one of the lateral plates 41 on the left. The waste toner conveyer 43 includes a conveyer tube 51, a plurality of connectors 52, a screw 53, and a shutter 54.

The conveyer tube 51 is arranged to longitudinally align along the front-rear direction and has a closed tubular form, of which front end and rear end are closed. The conveyer tube 51 is in an arrangement such that an upper part thereof overlaps lower ends of the photosensitive drums 11 when projected along the widthwise direction. The conveyer tube 51 includes a port 51A.

The port 51A is formed in a frontward position in the conveyer tube 51 to vertically bore through a bottom of the conveyer tube 51 and has a shape of a rectangle in a plan view seen from the bottom.

The connectors 52 are located in upper positions with respect to the conveyer tube 51 to be spaced apart from one another along the front-rear direction. The connectors 52 are arranged to each correspond to one of the plurality of drum cleaners 42; therefore, there may be four (4) connectors 52. Each of the connectors 52 has a tubular shape, which is formed to extend upward continuously from a top of the conveyer tube 51 and curve rightward. A rightward end of the connector 52 is connected to a leftward end of the cleaner-frame 45 of the corresponding one of the drum cleaners 42.

The conveyer screw 53 is located inside the conveyer tube 51 and is an auger screw arranged to longitudinally align along the front-rear direction. A front end and a rear end of the conveyer screw 53 are rotatably supported by a front wall and a rear wall that close the front and rear ends of the conveyer tube 51 respectively. The rearward part of the conveyer screw 53 penetrates through the rear wall of the conveyer tube 51 to protrude rearward from the rear wall of the conveyer tube 51. The conveyer screw 53 includes a gear 53A.

The gear 53A is supported on the rear end of the conveyer screw 53 at rearward position with respect to the rear wall of the conveyer tube 51. The gear 53 is not rotatable with respect to the conveyer screw 53 but is rotatable integrally with the conveyer screw 53. A driving force generated in the body 2 of the image forming apparatus 1 is transmitted to the gear 53A through a gear train, which is not shown, to rotate the conveyer screw 53.

The shutter 54 is located at a front end of the waste toner conveyer 43. The shutter 54 has a shape of a cylinder, which aligns longitudinally along the front-rear direction. The shutter 54 is, as shown in FIGS. 4B and 4C, movable to rotate about a central axis A of conveyer tube 51 between an opening position (see FIG. 4B), in which the port 51A of the conveyer tube 51 is exposed within the body 2, and a closed position (see FIG. 4C), in which the port 51A of the conveyer tube 51 is closed. In the following description, unless otherwise stated, the shutter 54 is described with reference to the opening position. The shutter 54 includes a sleeve 55 and a handle 56, and an engageable part 57.

The sleeve 55 is located at a rear end of the shutter 54. The sleeve 55 has a cylindrical shape aligning longitudinally along the front-rear direction. A front end of the sleeve 55 is closed, and a rear end of the sleeve 55 is open. The sleeve 55 is placed over the front end of the conveyer tube 51 to cover an outer circumference of the front end of the conveyer tube 51. The sleeve 55 includes a hole 55A.

The hole 55A is formed in a rearward position in the sleeve 55 to vertically bore through a bottom of the sleeve 55 and has a rectangular shape in a plan view seen from the bottom. The hole 55A is formed in a vertically coincident position with the port 51A of the conveyer tube 51.

The handle 56 is located in a frontward position in the shutter 54 with regard to the front-rear direction. The handle 56 protrudes frontward from the closed front end of the sleeve 55 and is elongated in a radial direction of the sleeve 55. The handle 56 has an approximate shape of a three-sided frame which is open rearward in a lateral view. The handle 56 may be placed in a first handling position, in which the handle 56 longitudinally aligns along the vertical direction in a front view, when the front cover 22 is in the closable position, to be accommodated in the groove 39A of the shutter-restrictive piece 39 of the front cover 22, as indicated by solid lines in FIG. 4A. When the front cover 22 is in the openable position, the handle 56 may be placed in a second handling position, in which the handle 56 longitudinally aligns along the widthwise direction in the front view to contact the blocker 39B of the shutter restrictive part 39 of the front cover, as indicated by dash-and-dot lines in FIG. 4A.

The engageable part 57 is arranged to protrude downward from a lower circumference of the front end of the shutter 54 (see FIG. 4B). The engageable part 57 has a shape of a plate. In other words, the engageable part 57 is a piece of protrusive plate that protrudes downward from the lower circumference of the front end of the shutter 54. A vertical dimension of the engageable part 57 is equal to the vertical dimension (depth) of the slit 29A of the slide-restrictive piece 29 and is longer than the distance between the contacting position and the separated position for the drum unit 9 to move. Thus, the engageable part 57 may fit in the slit 29A of the slide-restrictive piece 29.

4. Detailed Configuration of the Transfer Unit

The transfer unit 5 includes, as shown in FIGS. 5A-5B, a transfer-frame 60, a belt unit 61, and a belt cleaner 62.

The transfer-frame 60 has, as shown in FIGS. 5A and 6A, a shape of a box, which is open upward and has a bottom. The transfer-frame 60 includes a pair of lateral walls 63 and a bottom plate 64.

The paired lateral walls 63 are arranged on widthwise ends of the transfer-frame 60. Each of the lateral walls 63 has a shape of a rectangular plate, which stands vertically. Each lateral wall 63 has an elongated opening 63A and a compression spring 63B. One of the lateral walls 63 on the left further includes an exposable opening 65.

The elongated openings 63A are each formed in a frontward position in each of the lateral walls 63. Each elongated opening 63A has a rectangular shape elongated along the front-rear direction in a lateral view and bores through the lateral wall 63 sideward along the widthwise direction.

The compression springs 63B are each located in each of the elongated openings 63A. Each of the compression springs 63B is a coil spring stretching along the front-rear direction. The compression spring 63B is in an arrangement such that a front end thereof contacts a rear end of a rotation shaft 16A of the driven roller 16, and a rear end thereof contacts an inner and rear face of the elongated opening 63A. Thus, the compression springs 63B urge the rotation shaft 16A of the driven roller 16 frontward constantly.

The exposable opening 65 is formed in a front area in the lateral wall 63 on the left and in a frontward position with respect to the elongated opening 63A. The exposable opening 65 has a rectangular shape elongated along the vertical direction bored sideward through the lateral wall 63 on the left along the widthwise direction.

The bottom plate 64 is at a lower end of the transfer-frame 60. The bottom plate 64 is a flat plate spreading along the widthwise direction. Widthwise ends of the bottom plate 64 are connected with lower ends of the lateral walls 63. The bottom plate 64 includes a plurality of rollers 64A.

The rollers 64A are arranged at frontward and widthwise ends and rearward and widthwise ends of the bottom plate 64. The rollers 64A each has a shape of a disk in a lateral view and is rotatably supported on the bottom plate 64. An upper end of each roller 64A is in an upper position with respect to an upward surface of the bottom plate 64.

The belt unit 61 is, as shown in FIGS. 5B and 6B, located in an upper position in the transfer unit 5. The belt unit 61 includes the driving roller 15, the driven roller 16, the conveyer belt 17, and the transfer rollers 18, which are mentioned earlier. A rotation shaft 15A of the driving roller 15 is rotatably supported at a rearward position in the transfer-frame 60 of the transfer unit 5. The rotation shaft 16A of the driven roller 16 is arranged to penetrate through lateral walls of a cleaning unit 70 in the belt cleaner 62 and inserted in the elongated openings 63A of the transfer-frame 60.

The belt cleaner 62 is, as shown in FIGS. 5A and 6A, located in a lower-frontward position in the belt unit 61. The belt cleaner 62 includes a cleaner-frame 66 and a cleaning blade 67.

The cleaner-frame 66 of the belt cleaner 62 includes the cleaner unit 70, a container 68, and a joint 69.

The cleaning unit 70 is located in a frontward area in the belt unit 61 and in a frontward position with respect to the cleaner-frame 66. The cleaning unit 70 has a shape of a box, which stands vertically and spreads along the widthwise direction. Lateral walls of the cleaning unit 70 stretch rearward beyond a rear wall of the cleaning unit 70. The cleaning unit 70 includes an opening 70A.

The opening 70A is formed in an upper position on the rear wall of the cleaning unit 70. The opening 70A has a rectangular shape elongated along the widthwise direction in a front view and bores rearward through the rear wall of the cleaning unit 70 along the front-rear direction.

The container 68 is located in a lower position with respect to the belt unit 61. The container 68 has a boxed shape, which stretches rearward continuously with a lower end of the cleaning unit 70.

The joint 69 is located at a leftward end of the belt unit 61. The joint 69 is formed to extend upper-leftward continuously from the leftward end of the belt unit 61. The joint 69 is arranged to protrude leftward through the exposable opening 65 beyond the lateral wall 63 on the left. The joint 69 includes a dent 69A and an opening 69B.

The dent 69A is formed on an upper-leftward end in the joint 69. The dent 69A has a shape of an arc, which dents downward.

The opening 69B is formed at a central position in the dent 69A with regard to the widthwise direction and the front-rear direction to bore through an upper face of the joint 69 vertically.

The cleaning blade 67 is arranged on an upper end of the rear wall of the cleaning unit 70. The cleaning blade 67 has a shape of a plate stretching along the widthwise direction. The cleaning blade 67 is on a side opposite from the driven roller 16 across the cleaning belt 70 and is in an arrangement such that an upper end thereof is supported on an edge of the opening 70A on the rearward face of the cleaning unit 70, and a lower edge thereof contacts the conveyer belt 17.

5. Behaviors in Drum Cleaning and Belt Cleaning

Behaviors to clean the photosensitive drums 11 and the conveyer belt 17 will be described below.

When the toner images are transferred to the sheet P during the image forming operation in the image forming apparatus 1 described above (see FIG. 1), there may be residual toner, which is not transferred onto the sheet P but remains on the surfaces of the photosensitive drum 11. Further, there may be paper dust, which is transferred from the sheet P to the surfaces of the photosensitive drums 11.

Waste toner including such residual toner and paper dust may be scraped off from the surfaces of the photosensitive drums 11 by the cleaning blades 46 of the drum cleaners 42 as the photosensitive drums 11 rotate and stored inside the cleaner-frames 45 of the drum cleaners 42. Thus, each of the cleaning blades 46 cleans the surface of the corresponding one of the photosensitive drums 11.

The waste toner stored inside each cleaner-frame 45 is conveyed leftward by rotation of the screw 47 to the corresponding one of the connectors 52 of the waste toner conveyer 43 (see FIG. 2). The waste toner reaching the connectors 52 may fall in the conveyer tube 51 by the effect of gravity.

The waste toner falling in the conveyer tube 51 is conveyed frontward inside the conveyer tube 51 by rotation of the conveyer screw 53, and further through the port 51A of the conveyer tube 51 and the hole 55A of the shutter 54, to the opening 69B in the joint 69 of the belt cleaner 62 (see FIG. 3).

The waste toner reaching the opening 69B in the joint 69 passes through the opening 69B and enters the joint 69 by the effect of gravity to be stored in the container 68 (see FIGS. 5A and 6A).

Meanwhile, when the toner images are transferred to the sheet P during the image forming operation in the image forming apparatus 1 (see FIG. 1), there may be residual toner, which remains on the surface of the conveyer belt 17, and paper dust transferred from the sheet P. Further, there may be periodic events to form the toner images of test patterns on the surface of the conveyer belt 17 directly before the image forming operation with the sheet P is conducted in order to avoid misalignment of the toner images in the plurality of colors.

The residual toner and the paper dust adhered to the surface of the conveyer belt 17 may be scraped off from the surface of the conveyer belt 17 by the cleaning blade 67 of the belt cleaner 62 as the conveyer belt 17 circulates and stored in the container 68.

6. Exchanges of the Developer Cartridges

A flow to exchange the developer cartridges 10 will be described below.

First, a user removes the developer cartridge 10 from the body 2. In order to remove the developer cartridge 10 from the body 2, the user places the front cover 22 in the openable position (see FIG. 7). As the front cover 22 swings open, the paired tension springs 40 are stretched frontward, and the pair of lifts 30 are pulled frontward by resilient force of the tension springs 40. In this regard, the engageable bosses 30B slide in the guide grooves 37A of the guide members 37, and the lifts 30 are moved upper-frontward. As the lifts 30 move upper-frontward, the processing unit 3 moves upward to the separated position, and the photosensitive drums 11 are moved upward to be separated from the conveyer belt 17.

Meanwhile, as shown in FIG. 8, the waste toner conveyer 43 is moved upward to be separated from the dent 69A in the joint 69 of the belt cleaner 62. The shutter 54 being in the opening position is moved straight above with the lower part of the engageable part 57 maintained fitted in the slit 29A of the slide-restrictive piece 29. Thereby, the port 51A in the shutter 54 of the waste toner conveyer 43 is moved upward to be separated from the opening 69B in the connector 69 of the belt cleaner 61. Thus, the channel between the waste toner conveyer 43 and the belt cleaner 62 through the hole 55A of the shutter 54 and the opening 69B of the joint 69 is disconnected.

In the meantime, the lower end of the engageable part 57 of the shutter 54 remains engaged with an upper area of the slit 29A of the slide-restrictive piece 29 while the shutter 54 is in the opening position. In other words, the engageable part 57 remains partly coincident with the groove 29 in a view along the front-rear direction. Thereby, the processing unit 3 may be restricted from moving frontward while being placed in the separated position. In this regard, a distance D1 between the port 51A in the conveyer tube 51 and the opening 69B in the joint 69 of the belt cleaner 62 is longer than a distance D2, which is between the port 51A in the conveyer tube 51 and the opening 69B in the joint 69 of the belt cleaner 62 when the processing unit 6 is in the contacting position (see FIG. 3).

Next, the user may hold the handle 56 of the shutter 54 in the waste toner conveyer 43 and rotate the shutter 54 clockwise, in a front view, to place the shutter 54 in the closed position (see FIG. 4C).

When the shutter 54 is in the closed position, the hole 55A in the shutter 54 coincides with a leftward circumference of the conveyer tube 51. Meanwhile, the bottom of the sleeve 55 of the shutter 54 in the closed position coincides with the port 51A of the conveyer tube 51. In this regard, the engageable part 57 of the shutter 54 is moved upper-leftward to be separated from the slit 29A of the slide-restrictive piece 29. In other words, the engageable part 57 of the shutter 54 is disengaged from the slit 29*a* of the slide-restrictive piece 29 when the shutter 54 is in the closed position. Thereby, the processing unit 3 is released from the restriction from the slide-restrictive piece 29 and is allowed to move frontward.

Next, the user may pull the processing unit 3 frontward to place in the external position (see FIG. 9). In this regard, the protrusive strips 41A slide inside the guide grooves 30A in the lifts 30, and the photosensitive drums 11 being upwardly separated from the conveyer belt 17 are moved from the separated position to the external position.

Next, the user may pull a specific one or more of the developer cartridges 10 upward, as indicated by double-dotted lines in FIG. 9. Thereby, the developer cartridge(s) 10 may be fully separated from the body 2.

Thereafter, in order to complete exchange of the developer cartridges 10, the user may attach one or more of new developer cartridges 10 to the body 2. In order to attach the new developer cartridge 10 to the body 2, the user may follow the above-described process in a reversed order.

That is, the user may attach the new developer cartridge 10 to the processing unit 3 and push the processing unit 3 rearward into the body 2. The processing unit 3 may be placed in the separated position (see FIG. 7).

Next, the user may hold the handle 56B of the shutter 54 in the waste toner conveyer 43 and rotate counterclockwise, in the front view, to place the shutter 54B in the opening position (see FIGS. 4B and 8). Accordingly the lower end of the engageable part 57 of the shutter 54 fits in the upper area of the slit 29A of the slide-restrictive piece 29. Thereby, the processing unit 3 is restricted from moving frontward while being in the separated position.

Next, the user may move the front cover 22 to swing from the openable position to the closable position. Accordingly, the tension springs 40 contract as the front cover 22 swings, and the lift-restrictive pieces 38 contact the front ends of the lifts 30.

As the user moves the front cover 22 further to swing toward the closable position, the lifts 30 are pushed rearward by the lift-restrictive pieces 38, and the engageable bosses 30B are moved to slide in the guide grooves 37A of the guide members 37 lower-rearward. Accordingly, the processing unit 3 is moved downward as the lifts 30 move lower-rearward to the contacting position.

After the processing unit 3 is set in the contacting position, the front cover 22 may be placed in the closable position. Thus, attachment of the developer cartridges 10 to the body 2 is completed.

7. Effects

According to the image forming apparatus 1 described above, the port 51A in the conveyer tube 51 of the waste toner conveyer 43 may be arranged on the front end of the conveyer tube 51 (see FIG. 3). Meanwhile, the port 51A may be exposed or closed by the shutter 54 (see FIGS. 4B and 4C).

Thus, in order to move the processing unit 3 from the contacting position (see FIG. 1) to the external position (see FIG. 9), the shutter 54 on the front side may be moved so that the port 51A is closed while the processing unit 3 is in the separated position (see FIG. 7). Thereafter, with the engageable part 57 of the shutter 54 being outside the slit 29A of the slide-restrictive piece 29, the processing unit 3 may be allowed to move from the separated position to the external position. When the processing unit 3 is to be moved from the external position to the contacting position, the shutter 54 on the front side may be handled to be moved to open the port 51A after the processing unit 3 is moved to the contacting position.

Thus, the user may handle the shutter 54 from the position on the same side, i.e., the front side, as the user moves the processing unit 3. Therefore, within the simple configuration, the waste toner conveyer 43, which is movable along with the processing unit 3, may be connected to or separated from the belt cleaner 62, which stays steady in the body 2, smoothly.

According to the image forming apparatus 1 described above, as shown in FIG. 3, there may be the single port 51A of the conveyer tube 51 while the plurality of cleaning blades 46 are provided. Therefore, the waste toner cleaned by the plurality of cleaning blades 46 may be collectively conveyed by the waste toner conveyer 43 to be stored through the single port 51A in the belt cleaner 62. Accordingly, the connection between the waste toner conveyer 43 and the belt cleaner 62 may be established or disconnected easily and smoothly by the opening or closing motion of the single port 51A.

According to the image forming apparatus 1 described above, as shown in FIG. 4C, the processing unit 3 may be moved from the separated position to the external position with the shutter 54 maintained in the closed position. Therefore, the waste toner in the waste toner conveyer 43 may be prevented from leaking while the processing unit 3 is being moved outward to the external position.

According to the image forming apparatus 1 described above, as shown in FIGS. 3 and 4B, the shutter 54, when in the opening position, may restrict the processing unit 3 from moving from the separated position to the external position. On the other hand, as shown in FIG. 4C, when the shutter 54 is in the closed position, the processing unit 3 may be released from the restriction and allowed to move from the separated position to the external position. Therefore, it may be avoided that the processing unit 3 is moved to the external position with the port 51A being open. Accordingly, leakage of the waste toner through the port 51A while the processing unit 3 is moved outward to the external position may be prevented.

According to the image forming apparatus 1 described above, as shown in FIGS. 4B and 4C, the engageable part 57 in the shutter 54 may be arranged to fit in the slit 29A of the slide-restrictive piece 29 in the body 2 when the shutter 54 is in the opening position and to be separated from the slit 29A of the slide-restrictive piece 29 when the shutter 54 is in the closed position. Therefore, when the shutter 54 is in the opening position, engagement of the shutter 54 with the slide-restrictive piece 29 may restrict the processing unit 3 from moving in the front-rear direction. Meanwhile, when the shutter 54 is in the closed position, engageable part 57 of the shutter 54 is disengaged from the slide-restrictive piece 29 of the body 2; therefore, the processing unit 3 may be released from the restriction. Accordingly, the processing unit 3 may be securely prevented from moving to the external position when the port 51A is open.

According to the image forming apparatus 1 described above, as shown in FIG. 4B, the engageable part 54 of the shutter 57 may be a piece of protrusive plate, which extends downward from the lower end of the shutter 54 when the shutter 54 is in the opening position. Meanwhile, the slide-restrictive piece 29 may be formed to have the slit 29A, which is elongated along the vertical direction. Therefore, with the simple structure, in which the engageable part 57 of the shutter 54 is engaged with the slit 29A of the slide-restrictive piece 29, the processing unit 3 may be prevented from moving outward to the external position while the port 51A is open.

According to the image forming apparatus 1 described above, as shown in FIG. 8, the lower end of the engageable part 57 stays engaged in the upper area of the slide-restrictive piece 29 when the processing unit 3 is in the separated position. Therefore, even when the processing unit 3 is in the separated position, as long as the shutter 54 is in the opening position, the engagement between the engageable part 57 of the shutter 54 and the slide-restrictive piece 29 may be maintained. Therefore, until the shutter 54 is placed in the closed position, the processing unit 3 may be securely restricted from moving. Accordingly, the processing unit 3 may be securely prevented from moving to the external position when the port 51A is open.

According to the image forming apparatus 1 described above, as shown in FIGS. 4B and 4C, the shutter 54 may be provided with the handle 56, by which the shutter 54 is moved to the opening position and the closed position, on the front end of the shutter 54. With the handle 56 on the front side, the shutter 54 may be manipulated from the front side to be moved easily. Accordingly, the connection between the waste toner conveyer 43 and the belt cleaner 62 may be established and disconnected easily.

According to the image forming apparatus 1 described above, as shown in FIG. 4A, the handle 56 may be arranged to fit in the groove 39A of the shutter-restrictive piece 39 on the front cover 22 when the shutter 54 is in the opening position. On the other hand, as shown in the dash-and-dot lines in FIG. 4A, the handle 56 may not be placed to fit in the groove 39A of the shutter-restrictive piece 39 on the front cover 22 when the shutter 54 is in the closed position; therefore, the handle 56 is interfered with by the blockers 39B on the right and left sides so that the front cover 22 may be restricted from moving to the closable position. Accordingly, the front cover 22 may be restricted from moving toward the closable position while the shutter 54 is in the closed position. In other words, the front cover 22 may be allowed to move to the closable position after the shutter 54 is securely moved to the opening position. Thus, when the front cover 22 covers the aperture 21, the connection between the waste toner conveyer 43 and the belt cleaner 62 may be securely established. Accordingly, the waste toner may be conveyed to the belt cleaner 62 securely.

According to the image forming apparatus 1 described above, as shown in FIGS. 4B and 4C, the user may hold the handle 56, which aligns along the radial direction of the sleeve 55, to rotate the shutter 54 about the central axis of the sleeve 55. Therefore, with the simple operation, the shutter 54 may be moved between the opening position and the closed position easily.

According to the image forming apparatus described above, as shown in FIGS. 7 and 9, the processing unit 3 may be moved from the contacting position to the separated position while being accommodated inside the body 2 so that the photosensitive drums 11 should not contact the conveyer belt 17 while being moved outward to the external position. Thus, when the processing unit 3 is moved, the photosensitive drums 11 may be prevented from being rubbed on the conveyer belt 17 or damaged by the conveyer belt 17.

According to the image forming apparatus 1 described above, as shown in FIGS. 3 and 8, the port 51A in the waste toner conveyer 43 may be connected with the opening 69B of the belt cleaner 62 when the processing unit 3 moves from the separated position (see FIG. 8) to the contacting position (see FIG. 3) and may be disconnected from the opening 69B of the belt cleaner 62 when the processing unit 3 moves from the contacting position (see FIG. 3) to the separated position (see FIG. 8). Thus, the behavior of the processing unit 3 to move between the contacting position and the separated position may be effectively used to connect or disconnect the port 51A of the waste toner conveyer 43 to or from the opening 69B of the belt cleaner 62.

According to the image forming apparatus 1 described above, as shown in FIGS. 3 and 8, the distance D1 between the port 51A in the waste toner conveyer 43 and the opening 69B in the belt cleaner 62 when the processing unit 3 is in the separated position may be greater than the distance D2 between the port 51A in the waste toner conveyer 43 and the opening 69B in the belt cleaner 62 when the processing unit 3 is in the contacting position. Therefore, when the processing unit 3 is in the separated position, the port 51A in the waste toner conveyer 43 may be disconnected from the opening 69B in the belt cleaner 62 sufficiently.

According to the image forming apparatus 1 described above, as shown in FIGS. 3, 8, and 4B, the processing unit 3 may be shifted from the contacting position straight above to the separated position with the engageable part 57 in the shutter 54 being engaged with the slit 29A of the slide-restrictive piece 29. Meanwhile, the port 51A in the waste toner conveyer 43 may be moved straight above from the opening 62 of the belt cleaner 62 along with the shift of the processing unit 3. Therefore, even if the waste toner falls from the waste toner conveyer 43 through the port 51A, the waste toner may be caught in the belt cleaner 62, which is in the straight below, through the 69B. Therefore, it may be prevented that the area around the dent 69A of the joint 69 in the belt cleaner 62 is blotted by the waste toner fallen from the waste toner conveyer 43 through the port 51A.

According to the image forming apparatus described above, as shown in FIGS. 1 and 7, the processing unit 3 may be moved from the contacting position to the separated position in conjunction with the opening motion of the front cover 22 moving from the closable position to the openable position. Therefore, the behavior of the front cover 22 to shift from the closable position to the openable position may be effectively used to move the processing unit 3 from the contacting position to the separated position smoothly.

According to the image forming apparatus 1 described above, as shown in FIGS. 2 and 3, the waste toner conveyer 43 may overlap the lower ends of the photosensitive drums 11 when projected along the widthwise direction. Therefore, the space on the widthwise outer side of the photosensitive drums 11 may be used to arrange the waste toner conveyer 43 efficiently. Thereby, a volume of the processing unit 3 may be prevented from being increased.

According to the image forming apparatus 1 described above, as shown in FIGS. 2 and 3, the waste toner conveyer 43 may include the conveyer screw 53 aligning along the front-rear direction and the cylindrical conveyer tube 51, which accommodates the conveyer screw 53 and has the port 51A. Thereby, the waste toner may be conveyed within the conveyer tube 51 rearward by rotation of the conveyer screw 53. Thus, with the simple complicated structure, the waste toner may be conveyed in the front-rear direction.

According to the image forming apparatus 1 described above, as shown in FIGS. 4B and 4C, the shutter 54 may be movable to rotate about the central axis A of the conveyer tube 51 between the opening position and the closed position. Thus, with the simple structure, the shutter 54 may be movable between the opening position and the closed position.

According to the image forming apparatus 1 described above, as shown in FIGS. 4B and 4C, the belt cleaner 62 may have the opening 69B, which is connected with the port 51A of the waste toner conveyer 43 when the shutter 54 is in the opening position. Therefore, when the shutter 54 is in the opening position, the waste toner conveyer 43 and the belt cleaner 62 may establish the communication through the port 51A in the waste toner conveyer 43 and the opening 69B of the shutter 54. Thus, with the simple structure, the communication between the waste toner conveyer 43 and the belt cleaner 62 may be easily established.

8. MODIFIED EXAMPLES

Examples modified from the embodiment will be described below with reference to FIGS. 10-14. In the following description, items or structures which are the same as or similar to the items or the structures described above in the above first embodiment will be referred to by the same reference signs, and description of those will be omitted.

8-1. First Modified Example

8-1-1. Configuration of the First Modified Example

In the first embodiment described above, the shutter 54 is rotatable between the opening position and the closed position. Meanwhile, in the first modified example, a shutter 80 is slidable between an opening position (see FIG. 10) and a closed position (see FIG. 11) being at a frontward position with respect to the opening position.

The shutter 80 aligns longitudinally along the front-rear direction and has a cylindrical shape, of which front end is closed. The shutter 80 is placed over the front end of the conveyer tube 51 to cover an outer circumference of the front end of the conveyer tube 51. Unlike the shutter 54 described in the first embodiment, the shutter 80 does not have the handle 56 of the engageable part 57 but has a hole 80A.

The hole 80A is formed at a rearward position in the shutter 80 to vertically bore through a bottom of the conveyer tube 51. The hole 80A is formed in a vertically coincident position with the port 51A of the conveyer tube 51.

In a position between the front end of the conveyer tube 51 and a front wall of the shutter 80, disposed is a compression spring 81. The compression spring 81 is a coil spring stretching along the front-rear direction. The compression spring 81 is in an arrangement such that a rear end thereof contacts a frontward face of the conveyer tube 51, and a front end thereof contacts an inner and rearward surface of the front wall of the shutter 80. The compression spring 81 is compressed when the shutter 80 is in the opening position to urge the shutter 80 frontward.

The front cover 22 has a presser member 82. The presser member 82 is located at a lower-leftward end of the front cover 22. The presser member 82 protrudes rearward from the rear face of the front cover 22 and has a shape of a quadrangular plate in a lateral view. The presser member 82 presses the shutter 80 rearward when the front cover 22 is in the closable position and places the shutter 80 in the opening position against the urging force by the compression tension spring 81.

8-1-2. Exchange of Developer Cartridges

In order to exchange the developer cartridges 10 in the first modified example, first, the user may move the front cover 22 to swing frontward to the openable position (see FIG. 11).

As the front cover 22 swings open, the lifts 30 are pulled frontward by the resilient force of the tension springs 40 to move upper-frontward, and the processing unit 3 is placed in the separated position.

Meanwhile, the shutter 80 is shifted from the opening position to the closed position by the resilient force of the compression spring 81. Thus, in conjunction with the shift of the front cover 22 from the closable position to the openable position, the shutter 80 is moved from the opening position to the closed position.

Next, the user may pull the processing unit 3 frontward and pull a specific one or more of the developer cartridges 10 upward, similarly to the previous embodiment. Thereby, the developer cartridge(s) 10 may be fully separated from the body 2.

Thereafter, in order to complete exchange of the developer cartridges 10, the user may attach one or more of new developer cartridges 10 to the body 2 and push the processing unit 3 rearward into the body 2 so that the processing unit 3 may be placed in the separated position.

Thereafter, the user may move the front cover 22 to swing from the openable position to the closable position. The lifts 30 are pushed rearward by the lift-restrictive pieces 38 to move lower-rearward to place the processing unit 3 to the contacting position. Thereafter, the front cover 22 may be placed in the closable position.

Meanwhile, the shutter 80 may be pressed rearward by the presser member 82 on the front cover 22 to move from the closed position to the opening position against the resilient force of the compression spring 81. Thus, the shutter 80 may be moved from the closed position to the opening position in conjunction with the movement of the front cover 22 from the openable position to the closable position. Thus, attachment of the developer cartridges 10 to the body 2 is completed.

8-1-3. Effects

According to the first modified example, the shutter 80 may be moved to the closed position by handling the front cover 22 to move to the openable position and expose the aperture 21. Therefore, without an additional action to the shutter 80, the communication between the waste toner conveyer 43 and the belt cleaner 62 may be smoothly disconnected.

Further, the shutter 80 may be placed to the closed position securely as the front cover 22 is moved to the openable position and before the processing unit 3 is moved to the external position. Therefore, the waste toner in the waste toner conveyer 43 may be prevented from leaking while the processing unit 3 is being moved to the external position.

Meanwhile, the effects that may be caused by the first embodiment may be similarly achieved through the configuration of the first modified example.

8-2. Second Modified Example 8-2-1. Configuration of the Second Modified Example In the first embodiment described above, the shutter 54 has the engageable part 57, which may be fitted in the slide-restrictive piece 29 in the body 2. Meanwhile, in the second modified example, as shown in FIG. 12, the shutter 90 may include a handle 91, which is engageable with the front cover 22.

The handle 91 may be, as shown in FIGS. 13A-13B, located at the front end of the shutter 90. The handle 91 may include a shaft 92 and a knob 93.

The shaft 92 may have a cylindrical shape, which protrudes frontward from the front face of the sleeve 55.

The knob 93 may be arranged to protrude frontward from a front end of the shaft 92. The knob 93 may align along the widthwise direction when the shutter 90 is in an opening position (see FIGS. 13A and 13B). In this regard, a dimension of the knob 93 along the widthwise direction may be longer than a dimension of a slit 94 on the front cover 22, which will be described later in detail, along the widthwise direction. The knob 93 may have a shape of a rectangular plate.

Meanwhile, the front cover 22 may have the slit 94, through which the knob 91 may penetrate. The slit 94 is formed in a leftward position in the front cover 22. As shown in FIG. 13B, the slit 94 may be a through-hole, which has a rectangular shape in a front view elongated along the vertical direction. The slit 94 may include a shaft-penetration part 95 and a pair of alignment parts 96.

The shaft-penetration part 95 is formed at an approximate center of a dimension the slit 94 along the vertical direction and has a round shape in a front view. A diameter of the shaft-penetration part 95 is larger than a diameter of the shaft 92 of the handle 91.

The alignment parts 96 are each formed continuously to extend from the shaft-penetration part 95 upward and downward along the vertical direction. The alignment parts 96 each has a rectangular shape elongated along the vertical direction in the front view. A dimension of the alignment parts 96 along the widthwise direction is greater than a thickness of the knob 93.

8-2-2. Exchange of the Developer Cartridges

In order to exchange the developer cartridges 10 in the second modified example, first, the user may hold the knob 93 of the shutter 90 and rotate counterclockwise in the front view, as shown in FIGS. 13C and 13D, to place the shutter 90 in a closed position.

In this regard, the hole 55A of the shutter 90 may coincide with a leftward circumference of conveyer tube 51. Meanwhile, the bottom of the sleeve 55 in the shutter 90 may coincide with the port 51A of the conveyer tube 51.

In this regard, the knob 93 aligns with the slit 94 along the vertical direction, and the entire handle 91 fits in the slit 94 in the front view. Thereby, the front cover 22 may be released from the restriction and may be allowed to move from the closable position to the openable position.

Thereafter, the user may place the front cover 22 to the openable position, as shown in FIG. 14. In this regard, the knob 93 of the shutter 90 may pass through the slit 94.

Thereby, similarly to the first embodiment, the lifts 30 may be pulled forward by the resilient force of the tension springs 40 to move upper-frontward, and the processing unit 3 may be placed in the separated position.

Thereafter, the user may move the processing unit 3 to the external position and pull a specific one or more of the developer cartridges 10 upward, similarly to the first embodiment. Thereby, the developer cartridge(s) 10 may be fully separated from the body 2.

Thereafter, in order to complete exchange of the developer cartridges 10, the user may attach one or more of new developer cartridges 10 to the body 2 and push the processing unit 3 rearward into the body 2 so that the processing unit 3 may be placed in the separated position.

Thereafter, the user may place the front cover 22 to the closable position, as shown in FIG. 12. In this regard, the lifts 30 may be pushed rearward by the lift-restrictive pieces 38 to move lower-rearward, and the processing unit 3 may be placed in the contacting position. Meanwhile, as shown in FIGS. 13C and 13D, the knob 93 of the shutter 90 may pass through the slit 94 to protrude frontward from the slit 94 in the front cover 22. The shaft 92 of the shutter 92 may be arranged to penetrate through the shaft-penetration part 95.

Next, the user may hold the knob 93 and rotate the shutter 90 counterclockwise in the front view to place the shutter 90 in the opening position, as shown in FIGS. 13A and 13B.

Thereby, the knob 93 is arranged to align along the widthwise direction and faces with peripheral areas of the slit 94 in the front cover 22 along the widthwise direction. Thus, the front cover 22 may be restricted from moving from the closable position to the openable position. Thus, attachment of the developer cartridges 10 to the body 2 is completed.

8-2-3. Effects

According to the second modified example, as shown in FIGS. 12 and 13B, when the shutter 90 is in the opening position, the knob 93 of the shutter 90 may face with the widthwise peripheral areas of the slit 94, and the front cover 22 may be restricted from moving from the closable position to the openable position. Further, as shown in FIG. 13D, when the shutter 90 is in the closed position, the knob 93 of the shutter 90 may align with the alignment parts 96 of the slit 94, and the front cover 22 may be allowed to move from the closable position to the openable position.

Therefore, with the port 51A of the waste toner conveyer 43 being open, the aperture 21 may not be allowed to be exposed, and the processing unit 3 may not be allowed to move to the external position.

Accordingly, it may be prevented that the processing unit 3 is moved outward to the external position while the port 51A of the waste toner conveyer 43 is open.

Therefore, the waste toner in the waste toner conveyer 43 may be prevented from leaking while the processing unit 3 is being moved to the external position Meanwhile, the effects that may be caused by the previous embodiment may be similarly achieved through the configuration of the first modified example.

8-3 More Examples

Some more examples which may be modified from the previous embodiment will be described below.

The cleaning blades 46 in the drum cleaners 42 may be replaced with, for example, conductive cleaning brushes (not shown) or conductive cleaning rollers (not shown). With such cleaning brushes or cleaning rollers, scrapers such as blades may be additionally provided so that the toner adhered to the cleaning brushes or the cleaning rollers may be removed therefrom.

For another example, the screws 47 in the drum cleaners 42 and the screw 53 in the waste toner conveyer 43 may be replaced with another forms of conveyers. For example, a rotation shaft and fins made of thin films may be provided. Each fin may be attached to the rotation shaft at one end thereof, and the other end being a free end may be cut in a shape such that a distance between the rotation shaft and the free end may be shorter at a downstream part of the fin and longer at an upstream part of the fin with regard to the toner-conveying direction. For another example, the screws 42 and/or the screw 53 may be replaced with a belt-conveyer.

9. Second Embodiment

Referring to FIGS. 15-22, an image forming apparatus 101 according to a second embodiment will be described below. In the following description, items or structures which are the same as or similar to the items or the structures described in the previous embodiment will be referred to by the same reference signs, and description of those will be omitted.

The image forming apparatus 101 is a color laser printer capable of forming images in an intermediate transfer method.

9-1. Body

As shown in FIGS. 15-16, according to the second embodiment, a body 102 of the image forming apparatus 101 includes a pair of linkages 103, a manual sheet inlet 109, a manual sheet tray 108, a manual sheet path 107, an intermediate transfer unit 110, a secondary transfer roller 111, a belt cleaning unit 141, a connecting member 140, a second front cover 150, and an image reading unit 104.

9-1-1 Linkages

The paired linkages 103 each connects one of the paired lifts 30 with the front cover 22. In the following description, unless otherwise stated, directions concerning the linkages 103 will be based on a condition, in which the front cover 22 is in the openable position (see FIG. 19) and the linkages 103 are extended outward. Each linkage 103 includes a first link member 105 and a second link member 106.

The first link member 105 has a shape of a bar extending lower-frontward from a lower-front end of the corresponding one of the lifts 30. An upper-rear end of the first link member 105 is rotatably connected to the lower-front end of the corresponding one of the lifts 30.

The second link member 106 has a shape of a bar extending lower-frontward from a lower-front end of the first link 105. An upper-rear end of the second link member 106 is rotatably connected to a lower-front end of the first link member 105. A lower-front end of the second link member 106 is rotatably connected to the front cover 22.

9-1-2. Manual Sheet Inlet, Manual Sheet Tray, and Manual Sheet Path

The manual sheet inlet 109 is located at a lower end of the front cover 22. The manual sheet inlet 109 is formed to longitudinally align with the widthwise direction to bore through the front cover 22 along the front-rear direction.

The manual sheet tray 108 has a shape of a plate and is located in a frontward position with respect to the front cover 22. The manual sheet tray 108 is swingable about a lower end thereof between a standing position, in which the manual sheet tray 108 vertically aligns with the front cover 22 being in the closable position, and an inclined position, in which the manual sheet tray 108 leans frontward with respect to the front cover 22 being in the closable position to extend upper-frontward from the lower end thereof. The inclined position of the manual sheet tray 108 is indicated by double-dotted lines in FIG. 15. When the manual sheet tray 108 is in the standing position, the lower end of the manual sheet tray 108 is in a frontward position with respect to the manual sheet inlet 109 to close the manual sheet inlet 109. When the manual sheet inlet 108 is in the inclined position, the lower end of the manual sheet tray 108 is in a frontward position with respect to the manual sheet path 107 across the manual sheet inlet 109.

The manual sheet path 107 is located in a position between the feeder tray 7 and a processing unit 120. The processing unit 120 will be described below in detail. The manual sheet path 107 is formed to extend rearward from the front end of the body 105 to a frontward position with respect to a pickup roller R, which picks up the sheet P from the feeder tray 7. In other words, a rear end of the manual sheet path 107 is at the frontward position with respect to the pickup roller R. Thus, the sheet P set on the manual sheet tray 108 in the inclined position may be conveyed in the manual sheet path 107 to the pickup roller R.

9-1-3. Intermediate Transfer Unit, Belt Cleaning Unit, Connecting Member, and Second Cover The intermediate transfer unit 110 is located in a position between the processing unit 120 and the manual sheet path 107. The intermediate transfer unit 110 includes a driving roller 112, a driven roller 113, a tensile roller 116, an intermediate transfer belt 114, and a plurality of primary transfer rollers 115.

The driving roller 112 is located at a rear end of the intermediate transfer unit 110.

The driven roller 113 is located at a front end of the intermediate transfer unit 110 in a frontward and spaced apart position with respect to the driving roller 112. The driven roller 113 is, unlike the driven roller 16 mentioned earlier in the first embodiment, maintained stationary with respect to the body 102.

The tensile roller 116 is located in a lower-frontward and spaced apart position with respect to the driving roller 112. The tensile roller 116 is resiliently movable in the vertical direction to maintain a tensile force in the intermediate transfer belt 114 constant.

The intermediate transfer belt 114 is strained around the driving roller 112, the driven roller 113, and the tensile roller 116 in an arrangement such that an outer surface of an upper part of the intermediate transfer belt 114 should contact each one of the photosensitive drums 11. The intermediate transfer belt 114 is driven by rotation of the driving roller 112 and the driven roller 113 to circulate in a direction such that the upper part of the intermediate transfer belt 114 moves frontward and a lower part of the intermediate transfer belt 114 moves rearward.

Each of the primary transfer rollers 115 is located in a lower position with respect to a corresponding one of the photosensitive drums 11 across the upper part of the intermediate transfer belt 114.

The secondary transfer roller 111 is located in a lower-rear position with respect to the driving roller 112 in the intermediate transfer unit 110 across the intermediate transfer belt 114.

The belt cleaning unit 141 includes, as shown in FIGS. 15 and 17, a belt cleaner 142, a waste toner container 143, and a conveyer 145.

The belt cleaner 142 is located in an upper position with respect to the rear end of the intermediate transfer unit 110. The belt cleaner 142 includes a cleaner-frame 146, a scraper blade 147, a brush 148, and an auger screw 149.

The cleaner-frame 146 has an oval shape in a lateral view and includes a collecting hole 146A.

The collecting hole 146A is formed to bore through a bottom of the cleaner-frame 146.

The scraper blade 147 is located in a lower position with respect to the collecting hole 146A. The scraper blade 147 has a shape of a plate aligning longitudinally along the front-rear direction. An upper end of the scraper blade 147 is fixed to an upper edge of the collecting hole 146A of the cleaner-frame 146. The scraper blade 147 is arranged to have a rear edge thereof to contact the upper surface of the upper part of the intermediate transfer belt 114.

The brush 148 is located in an upper position with respect to the collecting hole 146A. The brush 148 is arranged to have a lower end thereof to contact an upper surface of the scraper blade 147.

The auger screw 149 is located in a frontward position with respect to the brush 148 to align longitudinally along the widthwise direction.

The waste toner container 143 is, as shown in FIGS. 16-17, located in a lower-leftward position in the body 102 to be detachably attached between the outer frame 31 and the inner frame 32. The waste toner container 143 has a shape of a box longitudinally aligning along the front-rear direction.

The conveyer 145 is, as shown in FIG. 17, located in a leftward position with respect to the belt cleaner 142. The conveyer 145 is a tube longitudinally aligning along the vertical direction. The conveyer 145 is connected to a front end of the belt cleaner 142 at an upper end thereof and is detachably attached to a rear end of the waste toner container 143 at a lower end thereof.

The connecting member 140 is located in a lower position with respect to a front end of the waste toner conveyer 123. The connecting member 140 is a tube longitudinally aligning along the vertical direction. The connecting member 140 is detachably attached to the front end of the waste toner container 143. The connecting member 140 includes an opening 140A.

The opening 140A is formed in a central position with regard to the widthwise direction and the front-rear direction on an upper end of the connecting member 140. The opening 140A is a hole formed to bore through an upper wall of the connecting member 140 vertically.

The second front cover 150 is located in a lower-leftward position with respect to the front end of the body 102 and in a frontward position with respect to the waste toner container 143 to face with the waste toner container 143. The second front cover 150 has a shape of a plate standing along the vertical direction and is supported by the front wall of the body 102 to be swingable about the lower end thereof. The second front cover 150 is swingable between an openable position, in which a lower-leftward area in the body 102 is exposed so that the waste toner container 143 may be detached or attached therethrough, and a closable position, in which the lower-leftward area in the body 102 is closed and the waste toner container 143 is restricted from being moved. The openable position of the second front cover 150 is indicated by double-dotted lines in FIG. 17, and the closable position of the second front cover 150 is indicated by solid lines in FIG. 17.

9-1-4. Image Reading Unit

The image reading unit 104 is located in an upper and spaced apart position with respect to the outlet tray 8. The image reading unit 104 is capable of reading an image formed on a sheet and generate image data based on the read image.

9-2. Detailed Configuration of Processing Unit

The processing unit 120 is, as shown in FIG. 15, located in a central area in the body 102. The processing unit 120 is movable inside the body 2 between a contacting position (see FIG. 15), at which the plurality of photosensitive drums 11 contact an intermediate transfer belt 114, and a separated position (see FIG. 19), which is an upper position with respect to the contacting position and at which the photosensitive drums 11 are separated from the intermediate transfer belt 114, while the processing unit 120 is accommodated inside the body 102. Further, the processing unit 120 is movable between the separated position and an external position (see FIG. 21), which is frontward with respect to the separated position and outside the body 2, through the aperture 21. The processing unit 120 includes a drawer unit 121 and a plurality of developer cartridges 122.

9-2-1. Drawer Unit

The drawer unit 121 has, as shown in FIGS. 15 and 16, a form of a frame, which is open upward, downward, and sideward. The drum unit 121 includes a waste toner conveyer 123.

The waste toner conveyer 123 is, as shown in FIGS. 16 and 17, located in a lower position in the drawer unit 121 on an outer (leftward) side of one of lateral walls on the left. The waste toner conveyer 123 includes a conveyer tube 124, a plurality of connectors 125, a conveyer screw 126, and a shutter 127.

The conveyer tube 51 is arranged to longitudinally align along the front-rear direction and has a closed tubular form, of which front and rear ends are closed. The conveyer tube 124 includes a port 124A.

The port 124A is formed in a frontward position in the conveyer tube 124 to vertically bore through a bottom of the conveyer tube 124 and has an approximate shape of a rectangle in a plan view from the bottom.

The connectors 125 are located in upper positions with respect to the conveyer tube 124 to be spaced apart from one another along the front-rear direction. The connectors 125 are arranged to each correspond to one of the plurality of processing cartridges 122; in other words, there are four (4) connectors 125. Each of the connectors 125 is in a tubular shape, which is formed to extend upward continuously from a top of the conveyer tube 124 and curve rightward. A rightward end of each connector 125 is arranged to penetrate through a leftward one of the lateral plates 41 in the drawer unit 122 to be placed in an area laterally inward in the drawer unit 121 along the widthwise direction.

The conveyer screw 126 is similar to the conveyer screw 126 mentioned earlier in the first embodiment and is arranged inside the conveyer tube 124. The conveyer screw 126 includes a gear 126A.

The shutter 127 is located at a front end of the waste toner conveyer 123. The shutter 127 is, as shown in FIGS. 18A-18B, movable between an opening position (see FIG. 18A), in which the port 124A of the conveyer tube 124 is exposed within the body 102, and a closed position (see FIG. 18B), in which the port 124A of the conveyer tube 124 is closed. In the following description, unless otherwise stated, the shutter 124 is described with reference to the opening position. The shutter 54 includes a main part 128, a handle 129, and a contact part 130.

The main part 128 has a cylindrical shape aligning longitudinally along the front-rear direction. A front end of the main part 128 is closed, and a rear end of the main part 128 is open. The main part 128 is placed over the front end of the conveyer tube 124 to cover an outer circumference of the front end of the conveyer tube 124. The main part 128 has a hole 128A.

The hole 128A is formed in a rearward position in the main part 128 to vertically bore through a bottom of the main part 128 and has an approximate shape of a rectangle in a plan view from the bottom. The hole 128A is formed in a vertically coincident position with the port 124A of the conveyer tube 124.

The handle 129 is arranged in a frontward position in the shutter 127. The handle 129 protrudes frontward from the front end of the main part 128 and extends along the vertical direction. The handle has a shape of an approximate shape of a three-sided frame which is open rearward in a lateral view.

The contact part 130 is arranged to protrude downward from a lower circumference of the rear end of the shutter 127. The contact part 130 has a shape of a plate. In other words, the contact part 130 is a piece of protrusive plate that protrudes downward from the bottom of the rear end of the shutter 127. A dimension of the contact part 130 along the vertical direction is longer than a distance for the processing unit 120 to move between the contacting position and the separated position. Thus, the contact part 130 may contact an upper end of the connecting member 140.

9-2-2. Processing Cartridges

Each of the processing cartridges 122 includes, as shown in FIG. 15, a photosensitive drum 11, a charger roller 12, a developer unit 131, and a drum cleaner 132.

The photosensitive drum 11 is rotatably supported by a lower part of a corresponding one of the processing cartridges 122.

The charger roller 12 is arranged in an upper-frontward position of the processing cartridge 122 to contact an upper-frontward end of the photosensitive drum 11.

The developer unit 131 is located in a rearward position with respect to the photosensitive drum 11. The developer unit 131 includes a developer roller 13 and a supplier roller 14 and contains toner in one of the corresponding colors in an upper area with respect to the developer roller 13 and the supplier roller 14.

The developer roller 13 is rotatably supported by the developer unit 131 to be exposed frontward at a lower position in the developer unit 131. The developer roller 13 is arranged to contact a rearward area of the corresponding one of the photosensitive drums 11.

The supplier roller 14 is arranged in a rearward position with respect to the developer roller 13 to contact a rearward area of the developer roller 13.

The drum cleaner 132 is located in a frontward position with respect to a corresponding one of the photosensitive drums 11 and includes, similarly to the drum cleaner 42 described earlier in the first embodiment, a cleaner-frame 45, a cleaning blade 46, and a screw 47. An opening 45A in the cleaner-frame 45 is formed to bore through a rear wall of the cleaner-frame 45 along the front-rear direction and coincides with the frontward end of the photosensitive drum 11 along the front-rear direction. The cleaning blade 46 is arranged to have a lower end thereof to contact the frontward end of the photosensitive drum 11.

In the second embodiment, the cleaner-frame 45 of the drum cleaner 132 includes, as shown in FIG. 16, a connector 133, which is connected with the connector 125 of the drawer unit 121.

The connector 133 has an cylindrical shape extending leftward from a lower-leftward end of the cleaner-frame 45 of the drum cleaner 132.

9-3. Image Forming Operation

When the image forming apparatus 101 starts forming an image, the charger rollers 12 charge the surfaces of the photosensitive drums 11 evenly, and the scanner unit 4 emits the laser beams toward the photosensitive drums 11 selectively according to the image data so that electrostatic latent images are formed in the areas selectively exposed to the laser beams on the photosensitive drums 11.

Meanwhile, the supplier rollers 14 supply the toner in the developer cartridges 10 to the developer rollers 13. The toner supplied to each developer roller 13 is frictionally charged between the developer roller 13 and the supplier roller 14 and carried on the developer roller 13.

The developer rollers 13 then supply the toner to the electrostatic latent images on the photosensitive drums 11. Thus, toner images are formed on the surfaces of the photosensitive drums 11.

The toner images formed on the surfaces of the photosensitive drums 11 are sequentially transferred onto the outer surface of the upper part of the intermediate transfer belt 114 so that a multiple-colored image is formed on the outer surface of the intermediate transfer belt 114.

Meanwhile, sheets P in the feeder tray 7 are picked up one-by-one along with rotation of the pickup roller R. Each sheet P is conveyed upper-rearward and conveyed to a position between the intermediate transfer belt 114 and the secondary transfer roller 111 at a predetermined timing. As the sheet P is conveyed upward to pass through the position between the intermediate transfer belt 114 and the secondary transfer roller 111, the colored image is transferred onto the sheet P.

The sheet P is thereafter exposed to heat and pressure from the heat roller 19 and the pressure roller 20 when the sheet P passes through an intermediate position between the heat roller 19 and the pressure roller 20 so that the colored image should be fixed thereon. The sheet P is thereafter discharged to the sheet outlet tray 8.

9-4. Behaviors in Drum Cleaning and Belt Cleaning

Behaviors to clean the photosensitive drums 11 and the intermediate transfer belt 114 in the image forming apparatus 101 in the second embodiment will be described below.

When the toner images are transferred to the sheet P during the image forming operation in the image forming apparatus 101 described above (see FIG. 15), there may be residual toner, which is not transferred onto the intermediate transfer belt 114 but remains on the surfaces of the photosensitive drum 11 in the processing cartridges 122.

Waste toner including such residual toner may be scraped off from the surfaces of the photosensitive drums 11 by the cleaning blades 46 of the drum cleaners 132 as the photosensitive drums 11 rotate and stored inside the cleaner-frames 45 of the drum cleaners 132.

The waste toner stored inside each cleaner-frame 45 is conveyed by rotation of the screw 47 leftward to the connector 125 of the corresponding one of the waste toner conveyer 123 (see FIG. 16). The waste toner reaching the connector 125 may fall in the conveyer tube 124 by the effect of gravity.

The waste toner falling in the conveyer tube 124 is conveyed frontward inside the conveyer tube 124 by rotation of the conveyer screw 126, and further through the port 124A of the conveyer tube 124 and the hole 128A of the shutter 128, to the opening 140A in the connecting member 140.

The waste toner reaching the opening 124A in the connecting member 140 passes through the opening 124A and enters the connecting member 140 by the effect of gravity to be stored in the waste toner container 143.

Meanwhile, when the toner images are transferred to the sheet P during the image forming operation (see FIG. 15), there may be residual toner, which remains on the surface of the intermediate transfer belt 114.

The residual toner adhered to the surface of the intermediate transfer belt 114 may be scraped off from the surface of the intermediate transfer belt 114 by the cleaning blade 147 of the belt cleaner 142 as the intermediate transfer belt 114 circulates and stored in the frontward area in the cleaner-frame 146.

The waste toner stored in the frontward area in the cleaner-frame 146 is, as shown in FIGS. 15 and 17, conveyed by the auger screw 149 to an upper area in the conveyer member 145 to pass through the conveyer member 145 and stored in the waste toner container 143.

9-6. Exchanges of the Processing Cartridges

A flow to exchange the processing cartridges 122 will be described below.

First, a user may remove the processing cartridges 122 from the body 102. In order to remove the processing cartridges 122 from the body 102, the user may place the front cover 22 in the openable position (see FIG. 19).

As the front cover 22 swings open, the linkages 103 are stretched frontward, and the lifts 30 are pulled frontward. In this regard, the engageable bosses 30B slide in the guide grooves 37A of the guide members 37, and the lifts 30 are moved upper-frontward.

As the lifts 30 move upper-frontward, the processing unit 120 moves upward to the separated position, and the photosensitive drums 11 are moved upward to be separated from the intermediate transfer belt 114.

Meanwhile, as shown in FIG. 20, the waste toner conveyer 123 is moved upward to be separated from the connecting member 140. Thereby, the hole 128A in the shutter 127 of the waste toner conveyer 123 is moved upward, and the channel between the waste toner conveyer 123 and the belt cleaner 62 through the hole 128A of the shutter 127 and the opening 140A of the connecting member 140 is disconnected.

In the meantime, the lower end of the contact part 130 of the shutter 127 remains faced with an upper-rearward end of the connecting member 140. Thereby, the processing unit 120 may be restricted from moving frontward while being placed in the separated position.

Next, the user may hold the handle 129 of the shutter 127 in the waste toner conveyer 123 and rotate the shutter 127 clockwise, in a front view, to place the shutter 127 in the closed position (see FIG. 18B).

When the shutter 127 is in the closed position, the hole 128A in the shutter 127 coincides with a leftward circumference of the conveyer tube 124. Meanwhile, the bottom of the main part 128 of the shutter 127 in the closed position coincides with the port 124A of the conveyer tube 124.

In this regard, the contact part 130 of the shutter 127 is moved upper-leftward to be separated from the rearward position with respect to the connecting member 140. Thereby, the contact part 130 and the connecting member 140 are disengaged, and the processing unit 120 is released from the restriction and is allowed to move frontward.

Next, the user may pull the processing unit 120 frontward to place in the external position (see FIG. 21). In this regard, the protrusive strips 41A slide inside the guide grooves 30A in the lifts 30, and the photosensitive drums 11 being upwardly separated from the intermediate transfer belt 114 are moved from the separated position to the external position.

Next, the user may pull a specific one or more of the processing cartridges 122 upward, as indicated by double-dotted lines in FIG. 21. Thereby, the processing cartridge(s) 122 may be fully separated from the body 102.

Thereafter, in order to complete exchange of the processing cartridges 122, the user may attach one or more of new processing cartridges 122 to the body 102. In order to attach the new processing cartridge 122 to the body 102, the user may follow the above-described process in a reversed order.

That is, the user may attach the new processing cartridges 122 to the drawer unit 121 and push the processing unit 120 rearward into the body 102. The processing unit 102 may be placed in the separated position (see FIG. 19).

Next, the user may hold the handle 129 of the shutter 127 in the waste toner conveyer 123 and rotate the shutter 127 counterclockwise, in the front view, to place the shutter 127 in the opening position (see FIGS. 18A and 20). Accordingly the lower end of the contact part 130 of the shutter 127 is placed in the rear area of the upper end of the connecting member 140. Thereby, the processing unit 120 is restricted from moving frontward while being in the separated position.

Next, the user may move the front cover 22 to swing from the openable position to the closable position. Accordingly, the linkages 103 collapse at joints between the first link member 105 and the second link member 106 and push the lifts 30 rearward.

Further, as the user moves the front cover 22 further to swing toward the closable position, the lifts 30 are pushed rearward, and the engageable bosses 30B are moved to slide in the guide grooves 37A of the guide members 37 lower-rearward. Accordingly, the processing unit 120 is moved downward as the pair of lifts 30 moves lower-rearward to the contacting position.

After the processing unit 120 is set in the contacting position, the front cover 22 is placed in the closable position. Thus, attachment of the processing cartridges 122 to the body 102 is completed.

When the waste toner container 143 is filled up with the collected waste toner, as indicated by the double-dotted lines in FIG. 17, the second front cover 150 may be open, and the waste toner container 143 may be pulled outside the body 102 so that a replacing empty waste toner container 143 may be attached to the body 102.

9-7. Effects

According to the image forming apparatus 101 of the second embodiment described above, the effects that may be caused by the first embodiment may be similarly achieved.

Although examples of carrying out the invention have been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

What is claimed is:

1. An image forming apparatus, comprising:

a body including a first wall and a second wall opposite to the first wall, the first wall having an aperture;

a processing unit movable between an inside position, in which the processing unit is inside the body, and an outside position, in which the processing unit is outside the body, through the aperture in the body, the processing unit comprising:

a first drum cleaner configured to remove waste toner from a first photosensitive drum, the first drum cleaner including a first cleaning blade arranged to contact the first photosensitive drum, and a first screw longitudinally extending in an axial direction of the first photosensitive drum;

a second drum cleaner configured to remove waste toner from a second photosensitive drum, the second drum cleaner including a second cleaning blade arranged to contact the second photosensitive drum, and a second screw longitudinally extending in an axial direction of the second photosensitive drum; and a waste toner conveyer configured to convey the waste toner removed by the first drum cleaner and the second drum cleaner, the waste toner conveyer including a conveyer tube longitudinally extending in a movable direction in which the processing unit is movable from the outside position to the inside position, the waste toner conveyer having a port, a conveyer screw located inside the conveyer tube, and a shutter movable between an opening position, in which the port is open, and a closed position, in which the port is closed, the port of the conveyer tube being arranged closer to the first wall of the body than to the second wall of the body when the processing unit is in the inside position; and a transfer unit comprising:

a belt unit including a belt arranged to contact the first photosensitive drum and the second photosensitive drum; and a belt cleaner including a container, the container having an opening which communicates with the port of the conveyer tube when the processing unit is in the inside position, wherein the processing unit is movable from the inside position to the outside position independently of the container of the belt cleaner such that the container remains inside the body when the processing unit is at the outside position and such that an entirety of the container is disposed lower than the processing unit when the processing unit is at the inside position.

2. The image forming apparatus according to claim 1, wherein the port comprises a single first opening provided to the first drum cleaner and the second drum cleaner.

3. The image forming apparatus according to claim 1, wherein the processing unit is movable from the inside position to the outside position when the shutter is in the closed position.

4. The image forming apparatus according to claim 1, wherein the shutter is configured to restrict the processing unit from moving from the inside position to the outside position when the shutter is in the opening position and to release the processing unit to be movable from the inside position to the outside position when the shutter is in the closed position.

5. The image forming apparatus according to claim 4, wherein the body comprises a first engageable part; and wherein the shutter comprises a second engageable part configured to be engaged with the first engageable part when the shutter is in the opening position and to be disengaged from the first engageable part when the shutter is in the closed position.

6. The image forming apparatus according to claim 5, wherein the second engageable part is a protrusive plate spreading in an orthogonal direction, the orthogonal direction extending orthogonally to the axial directions of the first photosensitive drum and the second photosensitive drum and to the movable direction; and wherein the first engageable part is a slit deepened in the orthogonal direction.

7. The image forming apparatus according to claim 5, wherein one end of the first photosensitive drum, in an orthogonal direction, and one end of the second photosensitive drum, in the orthogonal direction, are arranged to contact a transcription medium, the orthogonal direction extending orthogonally to the axial directions of the first photosensitive drum and the second photosensitive drum and to the movable direction;

wherein the processing unit is movable between a contacting position, in which the first photosensitive drum and the second photosensitive drum contact the transcription medium, and a separated position, in which the first photosensitive drum and the second photosensitive drum are separated from the transcription medium;

wherein the outside position is at a position extended from the separated position along the movable direction; and wherein the second engageable part coincides with the first engageable part in a view along the movable direction when the processing unit is in the separated position.

8. The image forming apparatus according to claim 1, wherein the body comprises a cover member, the cover member being movable between a first position, in which the cover member covers the aperture, and a second position, in which the aperture is exposed; and wherein the shutter is configured to move from the opening position to the closed position in conjunction with the movement of the cover member moving from the first position to the second position.

9. The image forming apparatus according to claim 1, wherein the body comprises a cover member, the cover member being movable between a first position, in which the cover member covers the aperture, and a second position, in which the aperture is exposed; and wherein the shutter comprises a restrictive part, the restrictive part being configured to restrict the cover member from moving from the first position to the second position when the shutter is in the opening position and to release the cover member from the restriction to move from the first position to the second position when the shutter is in the closed position.

10. The image forming apparatus according to claim 1, wherein the shutter comprises a handle, the handle being operable to move the shutter between the opening position and the closed position, the handle being arranged at an upstream position within the shutter with regard to the movable direction.

11. The image forming apparatus according to claim 10, wherein the body comprises a cover member, the cover member being movable between a first position, in which the cover member covers the aperture, and a second position, in which the aperture is exposed;

wherein the handle is movable between a first handling position, in which the handle protrudes from a downstream side toward an upstream side with regard to the movable direction when the shutter is in the opening position, and a second handling position, in which the handle is placed when the shutter is in the closed position;

wherein the cover member comprises a protrusive part configured to protrude from a downstream face of the cover member toward the downstream side with regard to the movable direction; and wherein the protrusive part comprises:

a groove configured to accommodate the handle and allow the cover member to be placed in the first position when the handle is in the first handling position; and a blocker configured to interfere with the handle and restrict the cover member from moving to the first position when the handle is in the second handling position.

12. The image forming apparatus according to claim 11, wherein the shutter further comprises a cylindrical part configured to fit with an upstream part of the waste toner conveyer with regard to the movable direction;

wherein the shutter is configured to be rotatable between the opening position and the closed position about a central axis of the cylindrical part;

wherein the handle is configured to protrude from an upstream face of the cylindrical part toward the upstream side with regard to the movable direction and to be elongated along a radial direction of the cylindrical part.

13. The image forming apparatus according to claim 1, wherein one end of the first photosensitive drum, in an orthogonal direction, and one end of the second photosensitive drum, in the orthogonal direction, are arranged to contact a transcription medium, the orthogonal direction extending orthogonally to the axial directions of the first photosensitive drum and the second photosensitive drum and to the movable direction;

wherein the processing unit is movable between a contacting position, in which the first photosensitive drum and the second photosensitive drum contact the transcription medium, and a separated position, in which the first photosensitive drum and the second photosensitive drum are separated from the transcription medium; and wherein the outside position is a position extended from the separated position along the movable direction.

14. The image forming apparatus according to claim 13, wherein the port is connected with the opening in conjunction with the movement of the processing unit from the separated position to the contacting position and is disconnected from the opening in conjunction with the movement of the processing unit from the contacting position to the separated position.

15. The image forming apparatus according to claim 13, wherein a distance between the port and the opening when the processing unit is in the separated position is longer than a distance between the port and the opening when the processing unit is in the contacting position.

16. The image forming apparatus according to claim 13, wherein the body comprises a cover member, the cover member being movable between a first position, in which the cover member covers the aperture, and a second position, in which the aperture is exposed; and wherein the processing unit is configured to move from the contacting position to the separated position in conjunction with the movement of the cover member from the first position to the second position.

17. The image forming apparatus according to claim 1, wherein the waste toner conveyer is arranged to coincide with the first photosensitive drum and the second photosensitive drum in a projected view along the axial directions of the first photosensitive drum and the second photosensitive drum.

18. The image forming apparatus according to claim 1, wherein the conveyer screw is configured to rotate about an axis extending along the movable direction; and wherein the conveyer tube is configured to accommodate the conveyer screw and to comprise the port.

19. The image forming apparatus according to claim 18, wherein the shutter is configured to rotate about a central axis of the cylindrical conveyer tube to move between the opening position and the closed position.

20. The image forming apparatus according to claim 1, wherein the conveyer tube is cylindrically-shaped.

21. The image forming apparatus according to claim 1, wherein the shutter comprises a shutter opening configured to be connectable with the port when the shutter is in the opening position.

* * * * *